US007252247B2

(12) United States Patent
Holm et al.

(10) Patent No.: US 7,252,247 B2
(45) Date of Patent: Aug. 7, 2007

(54) SELF-CLEANING SPRAY NOZZLE

(75) Inventors: Per Holm, Vanløse (DK); Elo Nielsen, St. Merløse (DK)

(73) Assignee: LifeCycle Pharma A/S, Horsholm (DK)

( * ) Notice: Subject to any disclaimer, the term of this patent is extended or adjusted under 35 U.S.C. 154(b) by 397 days.

(21) Appl. No.: 10/519,992

(22) PCT Filed: Dec. 22, 2003

(86) PCT No.: PCT/DK03/00932

§ 371 (c)(1),
(2), (4) Date: Jan. 4, 2005

(87) PCT Pub. No.: WO2004/056487

PCT Pub. Date: Jul. 8, 2004

(65) Prior Publication Data

US 2005/0242209 A1 Nov. 3, 2005

(30) Foreign Application Priority Data

Dec. 20, 2002 (DK) ..... 2002 01987

(51) Int. Cl.

| | |
|---|---|
| ***A62C 31/00*** | (2006.01) |
| ***B05B 7/12*** | (2006.01) |
| ***B05B 7/06*** | (2006.01) |
| ***F23D 11/10*** | (2006.01) |

(52) U.S. Cl. ..... 239/398; 239/416; 239/416.4; 239/416.5; 239/417; 239/423; 239/424; 239/104; 239/105; 239/112; 239/128; 239/420; 239/422; 239/428; 239/451; 239/458

(58) Field of Classification Search ..... 239/398, 239/290, 291, 292, 297, 300, 301, 416, 416.4, 239/416.5, 417, 423, 424, 428, 451
See application file for complete search history.

(56) References Cited

U.S. PATENT DOCUMENTS

| | | | | |
|---|---|---|---|---|
| 2,712,961 | A | 7/1955 | Richardson | |
| 3,746,253 | A * | 7/1973 | Walberg | 239/705 |
| 4,022,379 | A * | 5/1977 | Ladisch | 239/8 |
| 4,036,434 | A | 7/1977 | Anderson et al. | |
| 4,347,984 | A * | 9/1982 | Sickles | 239/690.1 |
| 4,701,353 | A | 10/1987 | Mutsers et al. | |
| 5,697,553 | A * | 12/1997 | Stotts | 239/8 |
| 5,884,846 | A | 3/1999 | Tan | |
| 6,382,526 | B1 * | 5/2002 | Reneker et al. | 239/294 |

FOREIGN PATENT DOCUMENTS

| | | |
|---|---|---|
| DE | 27 46 489 A1 | 4/1979 |
| DE | 101 16 051 A1 | 10/2002 |
| FR | 1 125 303 | 10/1956 |
| WO | WO 03/051501 A1 | 6/2003 |
| WO | WO 03/051505 A1 | 6/2003 |

* cited by examiner

*Primary Examiner*—Davis Hwu
(74) *Attorney, Agent, or Firm*—Volentine & Whitt, P.L.L.C.

(57) ABSTRACT

A self-cleaning spray nozzle, and in particular a self-cleaning spray nozzle for use in an apparatus for the preparation of a particulate material by a controlled agglomeration method, for example a method for controlled growth of particle size. The apparatus is especially suitable for use in the preparation of pharmaceutical compositions containing a therapeutically and/or prophylactically active substance which has a relatively low aqueous solubility and/or which is subject to chemical decomposition.

29 Claims, 17 Drawing Sheets

SELF-CLEANING SPRAY NOZZLE

CROSS REFERENCE TO RELATED APPLICATIONS

This application is the national phase under 35 U.S.C. 371 of PCT international Application No. PCT/DK2003/000932 which has an international filing date of Dec. 22, 2003, and claims priority under 35 U.S.C. 119 to Danish application PA 2002 01987 filed on Dec. 20, 2002, which are hereby incorporated by reference.

FIELD OF THE INVENTION

The present invention relates to a self-cleaning spray nozzle and in particular to a self-cleaning spray nozzle for use in an apparatus for the preparation of a particulate material by a controlled agglomeration method, i.e. a method for controlled growth of particle size. The apparatus is especially suitable for use in the preparation of pharmaceutical compositions containing a therapeutically and/or prophylactically active substance which has a relatively low aqueous solubility and/or which is subject to chemical decomposition.

BACKGROUND OF THE INVENTION

The controlled agglomeration method is disclosed in International Patent Application No. PCT/DK02/00472 assigned to the present Applicant. The method enables preparation of pharmaceutical compositions for oral use that release the active substance from the composition in a suitable manner to enable an absorption of the active substance into the circulatory system.

A controlled agglomeration process may for example be carried out in a high or low shear mixer or in a fluid bed. According to the method, a carrier or a carrier composition is sprayed on a second composition, which is loaded into the mixer or the fluid bed. Typically, the carrier or the carrier composition is heated to a temperature above the melting point of the carrier and/or the carrier composition while the second composition is not subjected to any heating and thus, stays at ambient temperature. The difference in temperature between the carrier and the second composition makes the carrier solidify rapidly which in turn leads to a controlled growth of the particle size. Thus, the inventors have found that by employing such conditions it is possible to control the agglomeration process so that the growth in particle size is controlled.

Throughout the present description, the term "carrier" is used as an abbreviation of the term "carrier composition". A carrier composition comprises one or more carriers, optionally together with one or more other ingredients. Thus, the carrier composition may comprise a mixture of hydrophilic and/or hydrophobic carriers and/or surfactants. The carrier composition may also comprise one or more therapeutically and/or prophylactically active substances and/or one or more pharmaceutically acceptable excipients.

SUMMARY OF THE INVENTION

It is an object of the present invention to provide a self-cleaning spray nozzle that is capable of reliable co-operation with e.g. a shear mixer or a fluid bed in an apparatus operating in accordance with the controlled agglomeration method.

The spray nozzle should neither be susceptible to depositions of fluidised particles, carrier droplets, nor solidified carrier particles.

According to the present invention, the above-mentioned and other objects are fulfilled by a spray nozzle comprising a central tube with a central passage for supply of a liquid, the passage terminating in an orifice for discharge of the liquid, a second tube surrounding the central tube whereby a first passage is defined between the central tube and the second tube for supply of primary air, a nozzle cone positioned at the end of the second tube and defining the outer periphery of a first discharge gap of the first passage, causing air supplied through the first passage to be mixed with the liquid to provide a liquid/air spray, a third tube surrounding the second tube whereby a second passage is defined between the second and the third tube for supply of secondary air, and a jacket positioned at the end of the third tube and defining the outer periphery of a second discharge gap of the second passage.

Further, an apparatus is provided for controlled agglomeration, comprising the spray nozzle according to the present invention, and a fluid bed for fluidisation of a second composition.

The spray nozzle may be mounted at the top of the fluid bed, at the side of the fluid bed or at the bottom of the fluid bed as is well known in the art.

The fluid bed may e.g. be a roto fluid bed, a Wurster fluid bed, a Kugel coater, a Pharma Steel Phast fluid bed, etc.

Still further, an apparatus is provided comprising the spray nozzle and an intensive mixer for mixing of the second composition.

The intensive mixer may be a high shear mixer, a low shear mixer, a horizontal mixer, a vertical mixer etc.

Yet further, an apparatus is provided comprising the spray nozzle mounted in a spray dryer, e.g. mounted at the top of the spray dryer or mounted at the bottom of the spray dryer.

The second composition may have a temperature of at the most a temperature corresponding to a melting point of a carrier, such as a temperature of at least about 2° C., at least about 5° C. or at least about 10° C. lower than the melting point of the carrier. In the apparatus, the spray nozzle is mounted for spraying a first composition comprising the carrier in liquid form, on the second composition fluidised in the fluid bed or mixed in the intensive mixer, or the spray nozzle is mounted for spray drying the first composition in a spray dryer.

A temperature and pressure controlled tank containing the first composition is connected to the central passage for supply of the first composition at a temperature above the melting point of the carrier. Further, a first temperature controlled pressurised air supply that is connected to the first passage for supplying temperature controlled primary air to the spray nozzle, and a second temperature controlled pressurised air supply that is connected to the second passage for supplying temperature controlled secondary air to the spray nozzle.

During co-operation with the fluid bed, the intensive mixer, the spray dryer, etc, the spray nozzle according to the present invention is situated in a complex air flow that may transport particles or droplets of the first composition and particles of the second composition to surfaces of the spray nozzle. The temperature controlled secondary air supplied from the second discharge gap of the spray nozzle inhibits and substantially prevents deposition of such particles on the surfaces of the spray nozzle. Thus, the spray nozzle sustains spraying throughout the required process time.

The spray angle may further be controlled by appropriate adjustment of the secondary airflow. The secondary airflow may be utilised to increase the pressure at the orifice whereby the spray angle of the spray cone is decreased. The spray angle may be set to be less than 20°, preferably less than 15°, more preferred less than 10°, even more preferred less than 5°. A low value of the spray cone is preferred minimising the amount of sprayed material impinging on container walls.

The spray nozzle is well suited for spraying a high temperature melt in any environment.

It is believed that the advantageous cleaning effect of the secondary air is caused by the secondary airflow as such in combination with heating by the secondary air of the surfaces. There is an optimum temperature range for the secondary air. If the temperature of the secondary air is too high the particles or droplets tend to stick to the surfaces and, if the temperature is too low, droplets tend to solidify on the surfaces.

The optimum temperature range is related to the melting point of the carrier.

The carrier may have a melting point of about 5° C. or more such as, e.g., about 10° C. or more, about 20° C. or more or about 25° C. or more.

The temperature of the secondary air must be sufficiently low to cool the surface of the nozzle tip to the lower end of the melting temperature range of the carrier. If the temperature is higher, adhesion of liquid droplets might result in deposits of solid second composition material. If the temperature is lower, liquid droplets might solidify and act as seeding for build up of deposits.

As further described below, proper atomisation of the first composition requires that the primary air temperature at the nozzle orifice exceeds or at least corresponds to the melting temperature of the carrier. Because of the rapid temperature drop with distance to the nozzle orifice, a high temperature of the primary air is preferred. The upper temperature limit is defined by the boiling point of the carrier. However, the primary air heats the nozzle and thereby the outer surfaces of the nozzle, and therefore the heat insulation properties of the nozzle influence the maximum obtainable primary air temperature.

The sizes of the nozzle orifice and the first and second discharge gaps and their mutual positions are selected for optimum spray formation and self-cleaning. For example, the spray angle of the formed spray cone is selected to a low value so that the spray does not impinge on container walls.

In a preferred embodiment of the invention, the first discharge gap may be generally concentric with the orifice, and positioned at a distance upstream in relation to the orifice.

In a preferred embodiment of the invention, the second discharge gap may be generally concentric with the first discharge gap and positioned at a distance upstream in relation to the first discharge gap.

The diameter of the nozzle orifice may be between 0.1 mm and 3 mm, preferably between 0.5 mm and 2 mm.

The width of the first discharge gap may be less than 3 mm, preferably between 0.1 mm and 0.4 mm.

The width of the second discharge gap may be less than 3 mm, preferably between 0.1 mm and 0.4 mm.

Preferably, the spray nozzle comprises a nozzle tip comprising the orifice and a part of the central passage. The nozzle tip may be removably positioned in the spray nozzle facilitating maintenance, such as cleaning and sterilization.

Preferably, the spray nozzle comprises a central tube, the interior of which defines the central passage. The central tube may be made of stainless steel, such as acid resisting steel, e.g. AISI 316, or duplex steel, e.g. SAF 2205, etc.

In a preferred embodiment, the central tube is a flexible hose for easy instalment of the hose in the spray nozzle. The hose may be made of a heat-resistant plastic, such as PTFE, silicone, PVC, polyethylene, Teflon®, polyetheretherketone (PEEK), fluorescent, etc, and one end of the hose may be provided with a thread for fastening of the hose to the nozzle tip. In a preferred embodiment, the central tube is constructed with a Teflon® inner liner reinforced with a protective cover, e.g. a stainless steel cover, or a flexible cover, such as a braided cover of stainless steel, or a plastic cover.

Preferably, the central tube is removably positioned in the spray nozzle and may be discarded after use whereby cleaning and sterilization of the spray nozzle is facilitated. Preferably, the central tube and the nozzle tip form a unit that is removably positioned in the spray nozzle and may be discarded after use whereby cleaning and sterilization of the spray nozzle is facilitated. Cumbersome and time consuming cleaning of the central tube and nozzle tip between batch productions is hereby completely eliminated.

Further, the spray nozzle may comprise a second tube surrounding the central tube, the first passage being defined between the central tube and the second tube. Preferably, the second tube is made of stainless steel, such as AISI 316 or SAF 2205.

The spray nozzle may comprise a third tube surrounding the second tube, the second passage being defined between the second and the third tube. Preferably, the third tube is made of stainless steel, such as AISI 316 or SAF 2205.

A nozzle cone may be provided that is positioned at the end of the second tube, defining the periphery of the first discharge gap. Preferably, the nozzle cone is made of plastic, such as polycarbonate, or nylon, etc. More preferred, the nozzle cone is made of stainless steel, such as AISI 316 or SAF 2205. The nozzle cone may be adjustably positioned at the end of the second tube for adjustment of the size of the first discharge gap for optimum spray formation. Further, the nozzle cone may be removably attached to the second tube for easy maintenance and repair of the spray nozzle. For example, the nozzle cone may comprise a thread for engagement with a corresponding thread provided at the second tube. The position of the first discharge gap in relation to the nozzle orifice may be adjusted by rotation of the nozzle cone in relation to the second tube, the thread pitch determining the positional adjustment as a function of the angle of rotation. When the nozzle tip is tapered towards the orifice, the positional change of the first discharge gap also changes the width of the first discharge gap. A scale may be provided on the second tube and a mark on the nozzle cone, or vice versa, so that a desired first discharge gap width may be set by appropriate positioning of the marker in relation to the scale by corresponding rotation of the nozzle cone.

A jacket may be provided that is positioned at the end of the third tube and define the periphery of the second discharge gap. Further, the jacket may be adjustably positioned at the end of the third tube for adjustment of the size of the second discharge gap for optimum self-cleaning performance. Further, the jacket may be removably attached to the third tube for easy maintenance and repair of the spray nozzle.

For example, the nozzle jacket may comprise a thread for engagement with a corresponding thread provided at the third tube. The position of the second discharge gap in relation to the first discharge gap may be adjusted by rotation of the nozzle jacket in relation to the third tube, the thread pitch determining the positional adjustment as a function of the angle of rotation. When the nozzle cone is tapered towards the first discharge gap, the positional change of the second discharge gap also changes the width of the second discharge gap. A scale may be provided on the third tube and a mark on the nozzle jacket, or vice versa, so that a desired second discharge gap width may be set by appropriate positioning of the marker in relation to the scale by corresponding rotation of the nozzle jacket.

Preferably, the jacket is tapered towards the second discharge gap so that during spraying the jacket substantially does not present any horizontal surfaces whereby deposition of substance on the spray nozzle is further minimised.

The jacket may be made of stainless steel, such as AISI 316 or SAF 2205. Preferably, the jacket is made of a hardened plastic material, such as Peek, etc to obtain a heat stable, non-sticky jacket that does not absorb moisture.

It is preferred that different parts of the spray nozzle that are movably attached to each other, e.g. in a threaded engagement, as for example the nozzle cone and the second tube, are made of different types of stainless steel, such as AISI 316 and SAF 2205, respectively, to avoid reaming of the materials by moving of the parts in relation to each other.

The spray nozzle may be provided with a teflon coated surface, e.g. the jacket may be teflon coated, the nozzle cone may be teflon coated, etc, for further inhibition of deposition of particles on the respective surfaces.

The spray nozzle may be angled or bend so that it comprises a first part that extends along a first axis, and a second part extending along a second axis that forms an angle $\alpha$ with the first axis. The angle $\alpha$ may be approximately equal to 90°, or less than 90°, such as approximately equal to 60° facilitating positioning of the spray nozzle in a shear mixer, or a fluid bed, etc.

For further control of the spray angle of the spray cone, a member may be provided in the nozzle cone, the member having apertures or channels for passage of the primary air. The longitudinal axes of the apertures or channels may form an angle with a longitudinal axis of the second tube whereby a swirling flow is induced in the primary airflow. The swirling motion of the flow creates a vortex and a region of relatively low pressure whereby the spray angle is increased.

The apparatus enables incorporation in a solid material of a high load of a carrier of a type that, e.g. due to its solubility properties, enables a high load of therapeutically and/or prophylactically active substances with a relatively low aqueous solubility. The carrier is normally solid or semi-solid and normally it has a sticky, oily or waxy character. However, the carrier may also be fluid at room temperature or even at temperature below 5° C. and in such cases it is contemplated that the apparatus is operated by employment of cooling of the second composition. By employment of the novel controlled agglomeration apparatus a particulate material with a high load of carrier may be prepared and the resulting particulate material appears as a particulate powder in solid form. The particulate material obtained by the novel apparatus has excellent properties with respect to flowability, bulk density, compactability and thus, it is suitable for use in the preparation of e.g. tablets. Although the particulate material may have a high load of a carrier of substantially sticky character the particulate material prepared has minimal, if any, adherence to tablet punches and/or dies during manufacture of tablets.

Carriers

Preferably, the carrier is of a type which has a melting point of at least about 25° C. such as, e.g., at least about 30° C. at least about 35° C. or at least about 40° C. For practical reasons, the melting point may not be too high, thus, the carrier normally has a melting point of at the most about 300° C. such as, e.g., at the most about 250° C., at the most about 200° C., at the most about 150° C. or at the most about 100° C. If the melting point is higher then it becomes very difficult to ensure maintenance of a sufficient high temperature during the delivery of the carrier to the spraying equipment necessary to provide the melted carrier in the form of a spray. Furthermore, in those cases where e.g. a therapeutically and/or prophylactically active substance is included in the carrier, a relatively high temperature may promote e.g. oxidation or other kind of degradation of the substance.

In the present context, the melting point is determined by DSC (Differential Scanning Calorimetry). The melting point is determined as the temperature at which the linear increase of the DSC curve intersects the temperature axis (see FIG. 6 for further details).

Suitable carriers are generally substances, which are used in the manufacture of pharmaceuticals as so-called melt binders or solid solvents (in the form of solid dosage form), or as co-solvents or ingredients in pharmaceuticals for topical use.

The carrier may be hydrophilic, hydrophobic and/or they may have surface-active properties. In general hydrophilic and/or hydrophobic carriers are suitable for use in the manufacture of a pharmaceutical composition comprising a therapeutically and/or prophylactically active substance that has a relatively low aqueous solubility and/or when the release of the active substance from the pharmaceutical composition is designed to be immediate or non-modified. Hydrophobic carriers, on the other hand, are normally used in the manufacture of a modified release pharmaceutical composition. The above-given considerations are simplified to illustrate general principles, but there are many cases where other combinations of carriers and other purposes are relevant and, therefore, the examples above should not in any way limit the invention.

Examples on a suitable carrier are a hydrophilic carrier, a hydrophobic carrier, a surfactant or mixtures thereof.

Typically, a suitable hydrophilic carrier is selected from the group consisting of: polyether glycols such as, e.g., polyethylene glycols, polypropylene glycols; polyoxyethylenes; polyoxypropylenes; poloxamers and mixtures thereof, or it may be selected from the group consisting of: xylitol, sorbitol, potassium sodium tartrate, sucrose tribehenate, glucose, rhamnose, lactitol, behenic acid, hydroquinon monomethyl ether, sodium acetate, ethyl fumarate, myristic acid, citric acid, Gelucire 50/13, other Gelucire types such as, e.g., Gelucire 44/14 etc., Gelucire 50/10, Gelucire 62/05, Sucro-ester 7, Sucro-ester 11, Sucro-ester 15, maltose, mannitol and mixtures thereof.

A hydrophobic carrier for use in an apparatus of the invention may be selected from the group consisting of: straight chain saturated hydrocarbons, sorbitan esters, paraffins; fats and oils such as e.g., cacao butter, beef tallow, lard, polyether glycol esters; higher fatty acid such as, e.g. stearic acid, myristic acid, palmitic acid, higher alcohols such as, e.g., cetanol, stearyl alcohol, low melting point waxes such as, e.g., glyceryl monostearate, hydrogenated tallow, myristyl alcohol, stearyl alcohol, substituted and/or unsubstituted monoglycerides, substituted and/or unsubstituted diglycerides, substituted and/or unsubstituted triglycerides, yellow beeswax, white beeswax, carnauba wax, castor wax, japan wax, acetylate monoglycerides; NVP polymers, PVP polymers, acrylic polymers, or a mixture thereof.

In an interesting embodiment, the carrier is a polyethylene glycol having an average molecular weight in a range of from about 400 to about 35,000 such as, e.g., from about 800 to about 35,000, from about 1,000 to about 35,000 such as, e.g., polyethylene glycol 1,000, polyethylene glycol 2,000, polyethylene glycol 3,000, polyethylene glycol 4,000, polyethylene glycol 5,000, polyethylene glycol 6000, polyethylene glycol 7,000, polyethylene glycol 8,000, polyethylene glycol 9,000 polyethylene glycol 10,000, polyethylene glycol 15,000, polyethylene glycol 20,000, or polyethylene glycol 35,000. In certain situations polyethylene glycol may be employed with a molecular weight from about 35,000 to about 100,000.

In another interesting embodiment, the carrier is polyethylene oxide having a molecular weight of from about 2,000 to about 7,000,000 such as, e.g. from about 2,000 to about 100,000, from about 5,000 to about 75,000, from about 10,000 to about 60,000, from about 15,000 to about 50,000, from about 20,000 to about 40,000, from about 100,000 to about 7,000,000 such as, e.g., from about 100,000 to about 1,000,000, from about 100,000 to about 600,000, from about 100,000 to about 400,000 or from about 100,000 to about 300,000.

In another embodiment, the carrier is a poloxamer such as, e.g. Poloxamer 188, Poloxamer 237, Poloxamer 338 or Poloxamer 407 or other block copolymers of ethylene oxide and propylene oxide such as the Pluronic® and/or Tetronic® series. Suitable block copolymers of the Pluronic® series include polymers having a molecular weight of about 3,000 or more such as, e.g. from about 4,000 to about 20,000 and/or a viscosity (Brookfield) from about 200 to about 4,000 cps such as, e.g., from about 250 to about 3,000 cps. Suitable examples include Pluronic® F38, P65, P68LF, P75, F77, P84, P85, F87, F88, F98, P103, P104, P105, F108, P123, F123, F127, 10R8, 17R8, 25R5, 25R8 etc. Suitable block copolymers of the Tetronic® series include polymers having a molecular weight of about 8,000 or more such as, e.g., from about 9,000 to about 35,000 and/or a viscosity (Brookfield) of from about 500 to about 45,000 cps such as, e.g., from about 600 to about 40,000. The viscosities given above are determined at 60° C. for substances that are pastes at room temperature and at 77° C. for substances that are solids at room temperature.

The carrier may also be a sorbitan ester such as, e.g., sorbitan di-isostearate, sorbitan dioleate, sorbitan monolaurate, sorbitan monoisostearate, sorbitan monooleate, sorbitan monopalmitate, sorbitan monostearate, sorbitan sesquiisostearate, sorbitan sesquioleate, sorbitan sesquistearate, sorbitan tri-isostearate, sorbitan trioleate, sorbitan tristearate or mixtures thereof.

The carrier composition may of course comprise a mixture of different carriers such as, e.g., a mixture of hydrophilic and/or hydrophobic carriers.

In another interesting embodiment, the carrier is a surfactant or a substance having surface-active properties. It is contemplated that such substances are involved in the wetting of e.g. slightly soluble active substance and thus, contributes to improved solubility characteristics of the active substance.

Examples on surfactants are given in the following. In order to be suitable for use as a carrier, the criteria with respect to melting point and/or viscosity discussed herein must be fulfilled. However, the list below encompasses surfactants in general, because surfactants may also be added to the carrier composition in the form of pharmaceutically acceptable excipients.

Suitable excipients for use in a carrier composition (and—as discussed above—for use as carriers it selves) are surfactants such as, e.g., hydrophobic and/or hydrophilic surfactants as those disclosed in WO 00/50007 in the name of Lipocine, Inc. Examples on suitable surfactants are i) polyethoxylated fatty acids such as, e.g. fatty acid mono- or diesters of polyethylene glycol or mixtures thereof such as, e.g. mono—or diesters of polyethylene glycol with lauric acid, oleic acid, stearic acid, myristic acid, ricinoleic acid, and the polyethylene glycol may be selected from PEG 4, PEG 5, PEG 6, PEG 7, PEG 8, PEG 9, PEG 10, PEG 12, PEG 15, PEG 20, PEG 25, PEG 30, PEG 32, PEG 40, PEG 45, PEG 50, PEG 55, PEG 100, PEG 200, PEG 400, PEG 600, PEG 800, PEG 1000, PEG 2000, PEG 3000, PEG 4000, PEG 5000, PEG 6000, PEG 7000, PEG 8000, PEG 9000, PEG 1000, PEG 10,000, PEG 15,000, PEG 20,000, PEG 35,000, ii) polyethylene glycol glycerol fatty acid esters, i.e. esters like the above-mentioned but in the form of glyceryl esters of the individual fatty acids;

iii) glycerol, propylene glycol, ethylene glycol, PEG or sorbitol esters with e.g. vegetable oils like e.g. hydrogenated castor oil, almond oil, palm kernel oil, castor oil, apricot kernel oil, olive oil, peanut oil, hydrogenated palm kernel oil and the like, iv) polyglycerized fatty acids like e.g. polyglycerol stearate, polyglycerol oleate, polyglycerol ricinoleate, polyglycerol linoleate, v) propylene glycol fatty acid esters such as, e.g. propylene glycol monolaurate, propylene glycol ricinoleate and the like, vi) mono- and diglycerides like e.g. glyceryl monooleate, glyceryl dioleae, glyceryl mono- and/or dioleate, glyceryl caprylate, glyceryl caprate etc.;

vii) sterol and sterol derivatives;

viii) polyethylene glycol sorbitan fatty acid esters (PEG-sorbitan fatty acid esters) such as esters of PEG with the various molecular weights indicated above, and the various Tween® series;

ix) polyethylene glycol alkyl ethers such as, e.g. PEG oleyl ether and PEG lauryl ether;

x) sugar esters like e.g. sucrose monopalmitate and sucrose monolaurate;

xi) polyethylene glycol alkyl phenols like e.g. the Triton® X or N series;

xii) polyoxyethylene-polyoxypropylene block copolymers such as, e.g., the Pluronic® series, the Synperonic® series, Emkalyx®, Lutrol®, Supronic® etc. The generic term for these polymers is "poloxamers" and relevant examples in the present context are Poloxamer 105, 108, 122, 123, 124, 181, 182, 183, 184, 185, 188, 212, 215, 217, 231, 234, 235, 237, 238, 282, 284, 288, 331, 333, 334, 335, 338, 401, 402, 403 and 407;

xiii) sorbitan fatty acid esters like the Span® series or Ariacel® series such as, e.g. sorbinan monolaurate, sorbitan monopalmitate, sorbitan monooleate, sorbitan monostearate etc.;

xiv) lower alcohol fatty acid esters like e.g. oleate, isopropyl myristate, isopropyl palmitate etc.;

xv) ionic surfactants including cationic, anionic and zwitterionic surfactants such as, e.g. fatty acid salts, bile salts, phospholipids, phosphoric acid esters, carboxylates, sulfates and sulfonates etc.

When a surfactant or a mixture of surfactants is present in a carrier composition the concentration of the surfactant(s) is normally in a range of from about 0.1 -75% w/w such as, e.g., from about 0.1 to about 20% w/w, from about 0.1 to about 15% w/w, from about 0.5 to about 10% w/w, or alternatively, when applicable as a carrier or a part of the carrier composition from about 20 to about 75% w/w such as, e.g. from about 25 to about 70% w/w, from about 30 to about 60% w/w.

Other suitable excipients in a carrier composition may be solvents or semi-solid excipients like, e.g. propylene glycol, polyglycolised glycerides including Gelucire 44/14, complex fatty materials of plant origin including theobroma oil, carnauba wax, vegetable oils like e.g. almond oil, coconut oil, corn oil, cottonseed oil, sesame oil, soya oil, olive oil, castor oil, palm kernels oil, peanut oil, rape oil, grape seed oil etc., hydrogenated vegetable oils such as, e.g. hydrogenated peanut oil, hydrogenated palm kernels oil, hydrogenated cottonseed oil, hydrogenated soya oil, hydrogenated castor oil, hydrogenated coconut oil; natural fatty materials of animal origin including beeswax, lanolin, fatty alcohols including cetyl, stearyl, lauric, myristic, palmitic, stearic fatty alcohols; esters including glycerol stearate, glycol stearate, ethyl oleate, isopropyl myristate; liquid interesterified semi-synthetic glycerides including Miglycol 810/812; amide or fatty acid alcolamides including stearamide ethanol, diethanolamide of fatty coconut acids etc.

Other additives in the carrier composition may be antioxidants like e.g. ascorbic acid, ascorbyl palmitate, butylated hydroxyanisole, butylated hydroxytoluene, hypophosphorous acid, monothioglycerol, potassium metabisulfite, propyl gallate, sodium formaldehylde sulfoxylate, sodium metabisulfite, sodium thiosulfate, sulfur dioxide, tocopherol, tocopherol acetate, tocopherol hemisuccinate, TPGS or other tocopherol derivatives, etc. The carrier composition may also contain e.g. stabilising agents. The concentration of an antioxidant and/or a stabilizing agent in the carrier composition is normally from about 0.1% w/w to about 5% w/w.

In those cases where a carrier composition is employed, the requirements with respect to the melting point mentioned above normally also apply to the carrier composition, especially in those cases where a minor amount of water is included in the carrier composition. However, when the carrier composition is heated, the carrier composition may be in the form of two or more phases (e.g. two distinct liquid phases or a liquid phase comprising e.g. an active substance dispersed therein). In such cases, the melting point is not a true melting point but merely a heating point where the carrier composition becomes in a liquid form, which is suitable for use in a spraying device. Often such a heating point will for practical purposes correspond to the melting point of the carrier itself.

The total concentration of carrier(s) in the carrier composition is normally in a range of from about 5 to about 100% w/w such as, e.g., from about 10 to about 99.5% w/w, from about 15 to about 99% w/w, from about 15 to about 98% w/w, from about 15 to about 97% w/w, from about 20 to about 95% w/w such as at least about 25% w/w, at least about 30% w/w, at least about 35% w/w, at least about 40% w/w, at least about 45% w/w, at least about 50% w/w, at least about 55% w/w, at least about 60% w/w, at least about 65% w/w, at least about 70% w/w, at least about 75% w/w, at least about 80% w/w, at least about 85% w/w, at least about 90% w/w, at least about 95% w/w or at least about 98% w/w.

As explained above, in an apparatus according to the invention the carrier is brought on liquid form by heating the carrier and/or the carrier composition to a temperature, which causes the carrier, and/or the carrier composition to melt, and the carrier in liquid form (i.e. as a solution or a dispersion) is sprayed on the second composition.

As mentioned above, the carrier in melted or liquidized form is sprayed on a second composition. Thus, the carrier should have a suitable viscosity. If the viscosity is too high, the carrier or carrier composition will be too "thick" and will have a tendency of adhering to the nozzle, which may result in that the delivery through the nozzle is stopped. For the present purpose a viscosity of the carrier and/or the carrier composition is suitably if the viscosity (Brookfield DV-III) is at the most about 800 mPas at a temperature of at the most 100° C. such as, e.g., at the most 700, at the most 600, at the most 500 mPas. In those cases where the melting point of the carrier is more than about 80° C., the viscosity values mentioned above are at a temperature of about 40° C. above the melting point.

In the particulate material obtained by an apparatus according to the invention, the concentration of the carrier is from about 5 to about 95% w/w such as, e.g. from about 5 to about 90% w/w, from about 5 to about 85% w/w, from about 5 to about 80% w/w, from about 10 to about 75% w/w, from about 15 to about 75% w/w, from about 20 to abut 75% w/w, from about 25% to about 75% w/w, from about 30% to about 75% w/w. from about 35% to about 75% w/w, from about 25% to about 70% w/w, from about 30% to about 70% w/w, from about 35% to abut 70% w/w. from about 40% to about 70% w/w, from about 45% to about 65% w/w or from about 45% to about 60% w/w.

In those cases where the second composition comprises a pharmaceutically acceptable excipient that has a relatively high particle density it is preferred that the concentration of the carrier in the particulate material obtained by an apparatus of the invention is from about 5 to about 95% v/v such as, e.g. from about 5 to about 90% v/v, from about 5 to about 85% v/v, from about 5 to about 80% v/v, from about 10 to about 75% v/v from about 15 to about 75% v/v, from about 20 to abut 75% v/v, from about 25% to about 75% v/v, from about 30% to about 75% v/v, from about 35% to about 75% v/v, from about 25% to about 70% v/v, from about 30% to about 70% v/v, from about 35% to abut 70% v/v, from about 40% to about 70% v/v, from about 45% to about 65% v/v or from about 45% to about 60% v/v.

In the following is given a calculation example:

Recalculation from % w/w to % v/v (of total composition):

Particle density of lactose: 1.56 g/cm$^3$

Particle density of calcium hydrogen phosphate anhydrous: 2.89 g/cm$^3$

Particle density of PEG 6000: 1.17 g/cm$^3$

For lactose: w/w ratio of 50% PEG 6000/(lactose+PEG 6000) equals a % v/v of 56%

For calcium hydrogen phosphate anhydrous: w/w ratio of 50% PEG 6000/(calcium hydrogen phosphate anhydrous+PEG 6000) equals a % v/v of 71%.

In many cases it is suitable to dissolve or disperse a therapeutically and/or prophylactically active substance in the carrier or in the carrier composition. Suitable therapeutically and/or prophylactically active substances are discussed below.

In an apparatus according to the invention it is not necessary to employ water or an aqueous medium e.g. together with a binder in order to build up agglomerates of a suitable size. The agglomeration suitably takes place under water-free or substantially water-free conditions. Thus, the apparatus is also very useful when active substances or other ingredients are employed which are susceptible to water (e.g. degradation under aqueous conditions). However, if desired, water or an aqueous medium may of course be incorporated in the carrier composition. Although the carrier composition normally is essentially non-aqueous, water may be present to a certain extent and then the concentration of water in the carrier composition is the most about 20% w/w water such as at the most about 15% w/w, at the most abut 10% w/w, at the most about 5% w/w or at the most about 2.5% w/w.

Therapeutically and/or Prophylactically Active Substances

In a preferred embodiment of the invention the particulate material obtained by an apparatus according to the invention comprises a therapeutically and/or prophylactically active substance. The particulate matter may also or alternatively comprise a cosmetically active substance (i.e. a substance that is employed in cosmetic compositions). In an apparatus according to the invention the active substance may be included in the carrier composition and/or in the second composition.

In the present context a therapeutically and/or prophylactically active substance includes any biologically and/or physiologically active substance that has a function on an animal such as, e.g. a mammal like a human. The term includes drug substances, hormones, genes or gene sequences, antigen- comprising material, proteins, peptides, nutrients like e.g. vitamins, minerals, lipids and carbohydrates and mixtures thereof. Thus, the term includes substances that have utility in the treatment and/or preventing of diseases or disorders affecting animals or humans, or in the regulation of any animal or human physiological condition. The term also includes any biologically active substance which, when administered in an effective amount, has an effect on living cells or organisms.

Many active substances have and it is expected that many of the future drug substances will have undesired properties especially with respect to water solubility and to oral bioavailability. Therefore, a novel technology which enables especially therapeutically and/or prophylactically active substances to be delivered to the body in a relatively easy manner and at the same time enables the desired therapeutic and/or prophylactic response, is highly needed.

By employment of an apparatus according to the present invention it is contemplated that this object can be achieved for many such substances, especially in view of the promising results the inventors have obtained from a study in Beagle dogs. Accordingly, the present inventors have found very promising results with respect to bioavailability when an apparatus according to the invention is employed for the preparation of particulate material containing an active substance with a very low aqueous solubility. Thus, an apparatus according to the invention is especially suitable for use for the preparation of particulate material comprising an active substance that has an aqueous solubility at 25° C. and pH of 7.4 of at the most about 3 mg/ml such as, e.g., at the most about 2 mg/ml, at the most about 1 mg/ml, at the most about 750 μg/ml, at the most about 500 ML/ml, at the most about 250 ML/ml, at the most about 100 ML/ml, at the most about 50 ML/ml, at the most about 25 ML/ml, at the most about 20 ML/ml or at the most about 10 ML/ml. In specific embodiments the solubility of the active substance may be much lower such as, e.g., at the most about 1 ML/ml, at the most about 100 ng/ml, at the most about 75 ng/ml such as about 50 ng/ml.

As mentioned above, an apparatus according to the invention may advantageously be operated without employment of water or an aqueous medium. Thus, the apparatus is especially suitable for use for active substances that are degraded, decomposed or otherwise influenced by water.

Examples on active substances suitable for use in a particulate material according to the invention are in principle any active substance such as, e.g. freely water soluble as well as more slightly or insoluble active substances. Thus, examples on active substances suitable for use are e.g. antibacterial substances, antihistamines and decongestants, anti-inflammatory agents, antiparasitics, antivirals, local anesthetics, antifungals, amoebicidals or trichomonocidal agents, analgesics, antianxiety agents, anticlotting agents, antiarthritics, antiasthmatics, antiarthritic, anticoagulants, anticonvulsants, antidepressants, antidiabetics, antiglaucoma agents, antimalarials, antimicrobials, antineoplastics, antiobesity agents, antipsychotics, antihypertensives, antitussives, auto-immune disorder agents, anti-impotence agents, anti-Parkinsonism agents, anti-Alzheimers' agents, antipyretics, anticholinergics, anti-ulcer agents, anorexic, beta-blockers, beta-2 agonists, beta agonists, blood glucose-lowering agents, bronchodilators, agents with effect on the central nervous system, cardiovascular agents, cognitive enhancers, contraceptives, cholesterol-reducing agents, cytostatics, diuretics, germicidals, H-2 blockers, hormonal agents, hypnotic agents, inotropics, muscle relaxants, muscle contractants, physic energizers, sedatives, sympathomimetics, vasodilators, vasoconstrictors, tranquilizers, electrolyte supplements, vitamins, counterirritants, stimulants, anti-hormones, drug antagonists, lipid-regulating agents, uricosurics, cardiac glycosides, expectorants, purgatives, contrast materials, radiopharmaceuticals, imaging agents, peptides, enzymes, growth factors, etc.

Specific examples include e.g.

Anti-inflammatory drugs like e.g. ibuprofen, indometacin, naproxen, nalophine;

Anti-Parkinsonism agents like e.g. bromocriptine, biperidin, benzhexol, benztropine etc.

Antidepressants like e.g. imipramine, nortriptyline, pritiptyline, etc.

Antibiotics like e.g. clindamycin, erythomycin, fusidic acid, gentamicin, mupirocine, amfomycin, neomycin, metronidazol, sulphamethizole, bacitracin, framycetin, polymyxin B, acitromycin etc, Antifungal agents like e.g. miconazol, ketoconaxole, clotrimazole, amphotericin B, nystatin, mepyramin, econazol, fluconazol, flucytocine, griseofulvin, bifonazole, amorofine, mycostatin, itrconazole, terbenafine, terconazole, tolnaftate etc.

Antimicrobial agents like e.g. metronidazol, tetracyclines, oxytetracylines, peniciilins etc.

Antiemetics like e.g. metoclopramide, droperidol, haloperidol, promethazine etc.

Antihistamines like e.g. chlorpheniramine, terfenadine, triprolidine etc.

Antimigraine agents like e.g. dihydroergotamine, ergotamine, pizofylline etc.

Coronary, cerebral or peripheral vasodilators like e.g. nifedipine, diltiazem etc.

Antianginals such as, e.g., glyceryl nitrate, isosorbide dinitrate, molsidomine, verapamil etc.

Calcium channel blockers like e.g. verapamil, nifedipine, diltiazem, nicardipine etc.

Hormonal agents like e.g. estradiol, estron, estriol, polyestradiol, polyestriol, dienestrol, diethylstilbestrol, progesterone, dihydroprogesterone, cyprosterone, danazol, testosterone etc.

Contraceptive agents like e.g. ethinyl estradiol, lynestrenol, etynodiol, norethisterone, mestranol, norgestrel, levonorgestrel, desodestrel, medroxyprogesterone etc.

Antithrombotic agents like e.g. heparin, warfarin etc.

Diuretics like e.g. hydrochlorothiazide, flunarizine, minoxidil etc.

Antihypertensive agents like e.g. propanolol, metoprolol, clonidine, pindolol etc.

Corticosteroids like e.g. beclomethasone, betamethasone, betamethasone-17-valerate, betamethasone-dipropionate, clobetasol, clobetasol-17-butyrate, clobetasol-propionate, desonide, desoxymethasone, dexamethasone, diflucortolone, flumethasone, flumethasone-pivalte, fluocinolone acetonide, fluocinoide, hydrocortisone, hydrocortisone-17-butyrate, hydrocortisonebuteprate, methylprednisolone, triamcinolone acetonide, hacinonide, fluprednide acetate, alklometasone-dipropionate, fluocortolone, fluticasonpropionte, mometasone-furate, desoxymethasone, diflurason-diacetate, halquinol, cliochinol, chlorchinaldol, fluocinolone-acetonide etc.

Dermatological agents like e.g. nitrofurantoin, dithranol, clioquinol, hydroxyquinoline, isotretionin, methoxsalen, methotrexate, tretionin, trioxalen, salicylic acid, penicillamine etc.

Steroids like e.g. estradiol, progesterone, norethindrone, levonorgestrel, ethynodiol, levonorgestrol, norgestimate, gestanin, desogestrel, 3-keton-desogesterel, demegestone, promethoestrol, testosterone, spironolactone and esters thereof etc.

Nitro compounds like e.g. amyl nitrates, nitroglycerine and isosorbide nitrate etc.

Opioids like e.g. morphine, buprenorphine, oxymorphone, hydromorphone, codeine, tramadol etc.

Prostaglandins such as, e.g., a member of the PGA, PGB, PGE or PGF series such as, e.g. minoprostol, dinoproston, carboprost, eneprostil etc.

Peptides like e.g. growth hormone releasing factors, growth factors (e.g. epidermal growth factor (EGF), nerve growth factor (NGF), TGF, PDGF, insulin growth factor (IGF), fibroblast growth factor (aFGF, bFGF etc.), somatostatin, calcitonin, insulin, vasopressin, interferons, IL-2 etc., urokinase, serratiopeptidase, superoxide dismutase, thyrotropin releasing hormone, lutenizing hormone releasing hormone (LH-RH), corticotrophin releasing hormone, growth hormone releasing hormone (GHRH), oxytocin, erythropoietin (EPO), colony stimulating factor (CSF) etc.

Interesting examples on active substances that are slightly soluble, sparingly soluble or insoluble in water are given in the following tables:

TABLE 1

| | Poorly-Soluble Drug Candidates | |
|---|---|---|
| Drug Name | Therapeutic Class | Solubility In Water |
| Alprazolam | CNS | Insoluble |
| Amiodarone | Cardiovascular | Very Slightly |
| Amlodipine | Cardiovascular | Slightly |
| Astemizole | Respiratory | Insoluble |
| Atenolol | Cardiovascular | Slightly |
| Azathioprine | Anticancer | Insoluble |
| Azelastine | Respiratory | Insoluble |
| Beclomethasone | Respiratory | Insoluble |
| Budesonide | Respiratory | Sparingly |
| Buprenorphine | CNS | Slightly |
| Butalbital | CNS | Insoluble |
| Carbamazepine | CNS | Insoluble |
| Carbidopa | CNS | Slightly |
| Cefotaxime | Anti-infective | Sparingly |
| Cephalexin | Anti-infective | Slightly |
| Cholestyramine | Cardiovascular | Insoluble |
| Ciprofloxacin | Anti-infective | Insoluble |
| Cisapride | Gastrointestinal | Insoluble |
| Cisplatin | Anticancer | Slightly |
| Clarithromycin | Anti-infective | Insoluble |

TABLE 1-continued

| | Poorly-Soluble Drug Candidates | |
|---|---|---|
| Drug Name | Therapeutic Class | Solubility In Water |
| Clonazepam | CNS | Slightly |
| Clozapine | CNS | Slightly |
| Cyclosporin | Immunosuppressant | Practically Insoluble |
| Diazepam | CNS | Slightly |
| Diclofenac sodium | NSAID | Sparingly |
| Digoxin | Cardiovascular | Insoluble |
| Dipyridamole | Cardiovascular | Slightly |
| Divalproex | CNS | Slightly |
| Dobutamine | Cardiovascular | Sparingly |
| Doxazosin | Cardiovascular | Slightly |
| Enalapril | Cardiovascular | Sparingly |
| Estradiol | Hormone | Insoluble |
| Etodolac | NSAID | Insoluble |
| Etoposide | Anticancer | Very Slightly |
| Famotidine | Gastrointestinal | Slightly |
| Felodipine | Cardiovascular | Insoluble |
| Fentanyl citrate | CNS | Sparingly |
| Fexofenadine | Respiratory | Slightly |
| Finasteride | Genito-urinary | Insoluble |
| Fluconazole | Antifungal | Slightly |
| Flunosolide | Respiratory | Insoluble |
| Flurbiprofen | NSAID | Slightly |
| Fluvoxamine | CNS | Sparingly |
| Furosemide | Cardiovascular | Insoluble |
| Glipizide | Metabolic | Insoluble |
| Glyburide | Metabolic | Sparingly |
| Ibuprofen | NSAID | Insoluble |
| Isosorbide dinitrate | Cardiovascular | Sparingly |
| Isotretinoin | Dermatological | Insoluble |
| Isradipine | Cardiovascular | Insoluble |
| Itraconzole | Antifungal | Insoluble |
| Ketoconazole | Antifungal | Insoluble |
| Ketoprofen | NSAID | Slightly |
| Lamotrigine | CNS | Slightly |
| Lansoprazole | Gastrointestinal | Insoluble |
| Loperamide | Gastrointestinal | Slightly |
| Loratadine | Respiratory | Insoluble |
| Lorazepam | CNS | Insoluble |
| Lovastatin | Cardiovascular | Insoluble |
| Medroxyprogesterone | Hormone | Insoluble |
| Mefenamic acid | Analgesic | Slightly |
| Methylprednisolone | Steroid | Insoluble |
| Midazolam | Anesthesia | Insoluble |
| Mometasone | Steroid | Insoluble |
| Nabumetone | NSAID | Insoluble |
| Naproxen | NSAID | Insoluble |
| Nicergoline | CNS | Insoluble |
| Nifedipine | Cardiovascular | Practically Insoluble |
| Norfloxacin | Anti-infective | Slightly |
| Omeprazole | Gastrointestinal | Slightly |
| Paclitaxel | Anticancer | Insoluble |
| Phenytoin | CNS | Insoluble |
| Piroxicam | NSAID | Sparingly |
| Quinapril | Cardiovascular | Insoluble |
| Ramipril | Cardiovascular | Insoluble |
| Risperidone | CNS | Insoluble |
| Saquinavir | Protease inhibitor | Practically insoluble |
| Sertraline | CNS | Slightly |
| Simvastatin | Cardiovascular | Insoluble |
| Terbinafine | Antifungal | Slightly |
| Terfenadine | Respiratory | Slightly |
| Triamcinolone | Steroid | Insoluble |
| Valproic acid | CNS | Slightly |
| Zolpidem | CNS | Sparingly |

TABLE 2

| Poorly-Soluble Drugs with Low Bioavailability | | | |
|---|---|---|---|
| Drug Name | Indication | Solubility In Water | Bioavailability |
| Astemizole | Allergic Rhinitis | Insoluble | Low-moderate |
| Cyclandelate | Peripheral vascular disease | Insoluble | Low |
| Perphenazine | Psychotic disorder | Insoluble | Low |
| Testosterone | Androgen Replacement Therapy | Insoluble | Low |
| Famotidine | GERD | Slightly soluble | Low (39-50%) |
| Budesonide | Allergic Rhinitis | Sparingly soluble | Low (~15%) |
| Mesalamine | Irritable Bowel Syndrome | Slightly soluble | Low (~20%) |
| Clemastine fumarate | Allergic Rhinitis | Slightly soluble | Low (~39%) |
| Buprenorphine | Pain | Slightly soluble | Low (<30%) |
| Sertraline | Anxiety | Slightly soluble | Low (<44%) |
| Auranofin | Arthritis | Slightly soluble | Low (15-25%) |
| Felodipine | Hypertension | Insoluble | Low (15%) |
| Isradipine | Hypertension | Insoluble | Low (15-24%) |
| Danazol | Endometriosis | Insoluble | Low |
| Loratadine | Allergic Rhinitis | Insoluble | Low |
| Isosorbide dinitrate | Angina | Sparingly soluble | Low (20-35%) |
| Fluphenazine | Psychotic disorder | Insoluble | Low (2-3%) |
| Spironolactone | Hypertension, Edema | Insoluble | Low (25%) |
| Biperiden | Parkinson's disease | Sparingly soluble | Low (29-33%) |
| Cyclosporin | Transplantation | Slightly soluble | Low (30%) |
| Norfloxacin | Bacterial Infection | Slightly soluble | Low (30-40%) |
| Cisapride | GERD | Insoluble | Low (35-40%) |
| Nabumetone | Arthritis | Insoluble | Low (35%) |
| Dronabinol | ANTIEMETIC | Insoluble | Low 10-20%) |
| Lovastatin | Hyperlipidemia | Insoluble | Low (~5%) |
| Simvastatin | Hyperlipidemia | Insoluble | Low (<5%) |

The amount of active substance incorporated in a particulate material (and/or in a pharmaceutical, cosmetic or food composition) may be selected according to known principles of pharmaceutical formulation. In general, the dosage of the active substance present in a particulate material according to the invention depends inter alia on the specific drug substance, the age and condition of the patient and of the disease to be treated.

A particulate material according to the invention may comprise a cosmetically active ingredient and/or a food ingredient. Specific examples include vitamins, minerals, vegetable oils, hydrogenated vegetable oils, etc.

Second Composition

As mentioned above the carrier or carrier composition is sprayed on a second composition. In order to be able to achieve a high amount of carrier in the final particulate material and in order to enable a controlled agglomeration of the particles comprised in the second composition, the present inventors have surprisingly found that in specific embodiments, the second composition should initially have a temperature which is at least about 10° C. such as, e.g., at least about 15° C., at least about 20° C., at least about 25° C., or at least about 30° C. below the melting point of the carrier or carrier composition (or, as discussed above, the heating point of the carrier composition). However, as mentioned above, a temperature difference of at least about 10° C. it is not always necessary. Thus, the second composition may have a temperature of at the most a temperature corresponding to the melting point of the carrier and/or of the carrier composition such as, e.g., a temperature of at least about 2° C., at least about 5° C. No external heating of the second composition is normally employed in the apparatus according to the invention, but in some cases it may be advantageous to employ a cooling via the inlet air. However, the temperature of the second composition may increase to a minor extent due to the working of the composition. However, the temperature must (or will) not be higher than at the most the melting point of the carrier or carrier composition such as, e.g. at the most about 5° C. such as at the most about 10° C., at the most about 15° C. or at the most about 20° C. below the melting point of the carrier. Accordingly, an apparatus of the invention can be carried out without any heating of the second composition, i.e. it can be carried out at ambient or room temperature (i.e. normally in a range of from about 20° C. to about 25° C.).

In contrast thereto, known melt granulation methods involve external heating of the material that is to be granulated (or agglomerated) together with a melt binder.

The second composition comprises pharmaceutically and/or cosmetically acceptable excipients and, furthermore, a therapeutically and/or prophylactically active substance may be present in the second composition.

In the present context the terms "pharmaceutically acceptable excipient" and "cosmetically acceptable excipient" are intended to denote any material, which is inert in the sense that it substantially does not have any therapeutic and/or prophylactic effect per se. Such an excipient may be added with the purpose of making it possible to obtain a pharmaceutical and/or cosmetic composition, which has acceptable technical properties.

Examples on suitable excipients for use in a second composition include fillers, diluents, disintegrants, binders, lubricants etc. or mixture thereof. As the particulate material obtained by an apparatus according to the invention may be used for different purposes, the choice of excipients is normally made taken such different uses into considerations. Other pharmaceutically acceptable excipients for use in a second composition (and/or in the carrier composition) are e.g. acidifying agents, alkalizing agents, preservatives, antioxidants, buffering agents, chelating agents, coloring agents, complexing agents, emulsifying and/or solubilizing agents, flavours and perfumes, humectants, sweetening agents, wetting agents etc.

Examples on suitable fillers, diluents and/or binders include lactose (e.g. spray-dried tagatose, lactose, α-lactose, β-lactose, Tabletose®, various grades of Pharmatose®, Microtose® or Fast-Floc®), microcrystalline cellulose (various grades of Avicel®, Elcema®, Vivacel®, Ming Tai® or Solka-Floc®), hydroxypropylcellulose, L-hydroxypropylcellulose (low substituted), hydroxypropyl methylcellulose (HPMC) (e.g. Methocel E, F and K, Metolose SH of Shin-Etsu, Ltd, such as, e.g. the 4,000 cps grades of Methocel E and Metolose 60 SH, the 4,000 cps grades of Methocel F and Metolose 65 SH, the 4,000, 15,000 and 100,000 cps grades of Methocel K; and the 4,000, 15,000, 39,000 and 100,000 grades of Metolose 90 SH), methylcellulose polymers (such as, e.g., Methocel A, Methocel A4C, Methocel A15C, Methocel A4M), hydroxyethylcellulose, sodium carboxymethylcellulose, carboxymethylene, carboxymethylhydroxyethylcellulose and other cellulose derivatives, sucrose, agarose, sorbitol, mannitol, dextrins, maltodextrins, starches or modified starches (including potato starch, maize starch and rice starch), calcium phosphate (e.g. basic calcium phosphate, calcium hydrogen phosphate, dicalcium phosphate hydrate), calcium sulfate, calcium carbonate, sodium alginate, collagen etc.

Specific examples of diluents are e.g. calcium carbonate, dibasic calcium phosphate, tribasic calcium phosphate, calcium sulfate, microcrystalline cellulose, powdered cellulose, dextrans, dextrin, dextrose, fructose, kaolin, lactose, mannitol, sorbitol, starch, pregelatinized starch, sucrose, sugar etc.

Specific examples of disintegrants are e.g. alginic acid or alginates, microcrystalline cellulose, hydroxypropyl cellulose and other cellulose derivatives, croscarmellose sodium, crospovidone, polacrillin potassium, sodium starch glycolate, starch, pregelatinized starch, carboxymethyl starch (e.g. Primogel® and Explotab®) etc.

Specific examples of binders are e.g. acacia, alginic acid, agar, calcium carrageenan, sodium carboxymethylcellulose, microcrystalline cellulose, dextrin, ethylcellulose, gelatin, liquid glucose, guar gum, hydroxypropyl methylcellulose, methylcellulose, pectin, PEG, povidone, pregelatinized starch etc.

Glidants and lubricants may also be included in the second composition. Examples include stearic acid, magnesium stearate, calcium stearate or other metallic stearate, talc, waxes and glycerides, light mineral oil, PEG, glyceryl behenate, colloidal silica, hydrogenated vegetable oils, corn starch, sodium stearyl fumarate, polyethylene glycols, alkyl sulfates, sodium benzoate, sodium acetate etc.

Other excipients which may be included in the second composition (and/or in the carrier composition) are e.g. colouring agents, taste-masking agents, pH-adjusting agents, solubilizing agents, stabilising agents, wetting agents, surface active agents, antioxidants, agents for modified release etc.

In certain cases it may be advantageously to incorporate a magnesium aluminometasilicate in the particulate material. It may be a part of the second composition or it may be added subsequently in order to facilitate a further processing of the particulate material (e.g. to prepare solid dosage forms like capsules or tablet). Magnesium aluminometasilicate is sold under the name Neusilin and is obtainable from Fuji Chemical Industries. Neusilin is normally used in order to improve filling capacity and compression property of powders and granules when added. Neusilin is also believed to reduce weight variation and to improve hardness and disintegration of tablets. Finally, Neusilin has an adsorption capability, which makes it suitable for use when processing waxy materials like oil extracts and waxes into pharmaceutical composition. Especially Neusilin UFL2 and US2 are said to be suitable for such a use.

Thus, in one aspect the invention relates to an apparatus, wherein the second composition comprises magnesium aluminosilicate and/or magnesium aluminometasilicate such as, e.g. Neusilin S1, Neusilin FH2, Neusilin US2, Neusilin UFL2 or the like. Other suitable substances are contemplated to be bentonite, kaolin, magnesium trisilicate, montmorillonite and/or saponite. In a still further embodiment, the second composition comprises magnesium aluminosilicate and/or magnesium aluminometasilicate such as, e.g., Neusilin, and the particulate material obtained has an content of carrier of at least about 30% v/v such as, e.g., at least about 40% v/v, at least about 50% v/v, at least about 60% v/v, at least about 70% v/v, at least about 75% v/v, at least about 80% v/v, at least about 85% v/v or at least about 90% v/v.

Besides the known use of Neusilin, the present inventors have found that specific qualities of magnesium aluminometasilicate (Neusilin) have excellent properties as glidants or anti-adhesive most likely due to the porous structure of Neusilin. Thus, Neusilin may advantageously be added in order to reduce any adherence of the particulate material to the manufacturing equipment in particular to the tabletting machine. In the examples herein is given a comparison of the anti-adhesive properties of Neusilin compared with known lubricants and Neusilin seems to be a very promising and novel candidate as a lubricant.

DETAILED DESCRIPTION OF PREFERRED EMBODIMENTS

An apparatus according to the invention may comprise a high or low shear mixer or a fluid bed. A first composition comprising the carrier is sprayed with the spray nozzle on the second composition, which is loaded into the mixer or the fluid bed. Typically, the carrier is heated to a temperature above the melting point of the carrier and/or the carrier composition. The second composition is not subjected to any heating and has normally ambient temperature. The difference in temperature between the carrier and the second composition makes the carrier solidify rapidly which in turn leads to a controlled growth of the particle size.

Figure 2:
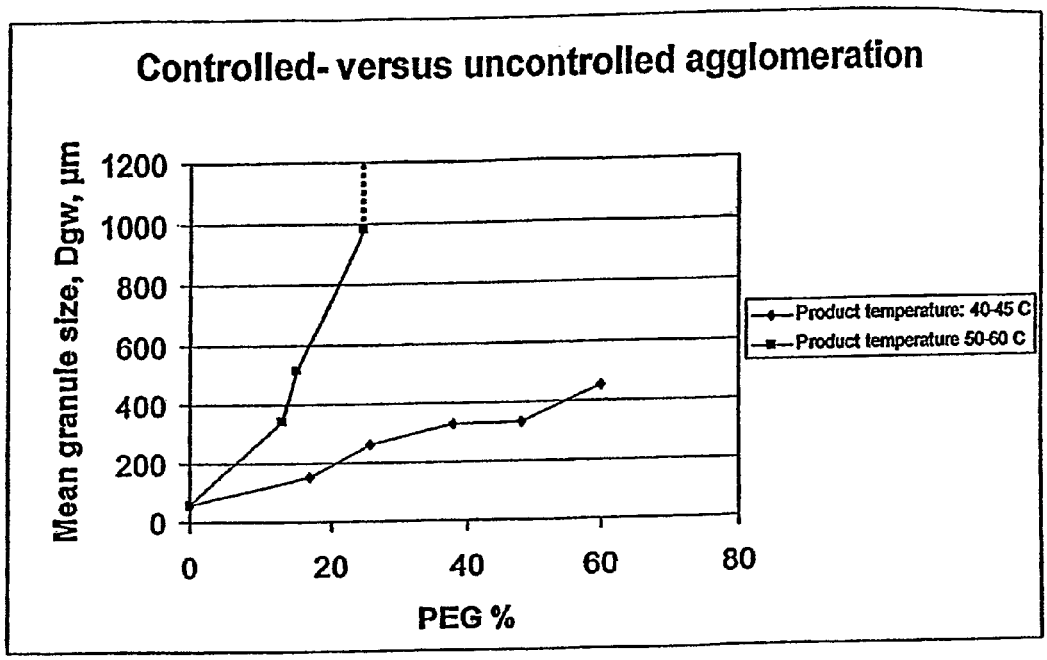
FIG. 2 shows the correlation between amounts of PEG 6000 sprayed onto lactose 125 mesh and mean granule size (geometric weight mean diameter) for a product temperature of 40-45° C. and 50-60° C., respectively. The dashed line indicates uncontrolled agglomeration at a PEG concentration of approx. 25% at a product temperature of 50-60° C. The products are unscreened.

In the present context, the term "controlled agglomeration" is intended to mean that the increase in mean geometric diameter of a material is a linear or approximated linear function of the carrier concentration in the carrier composition (see FIG. 2). Controlled agglomeration is also present if a geometric weight mean diameter $d_{gw}$ that is less than or equal to 500 μm is obtained when a carrier composition containing 20% carrier has been added to a second composition.

The geometric weight mean diameter may be determined by employment of a method of laser diffraction dispersing the particulate material obtained (or the starting material) in air. The measurements were performed at 1 bar dispersive pressure in Sympatec Helos equipment, which records the distribution of the equivalent spherical diameter. This distribution is fitted to a lognormal volume-size distribution.

When used herein, "geometric weight mean diameter" means the mean diameter of the lognormal volume-size distribution.

Figure 1:
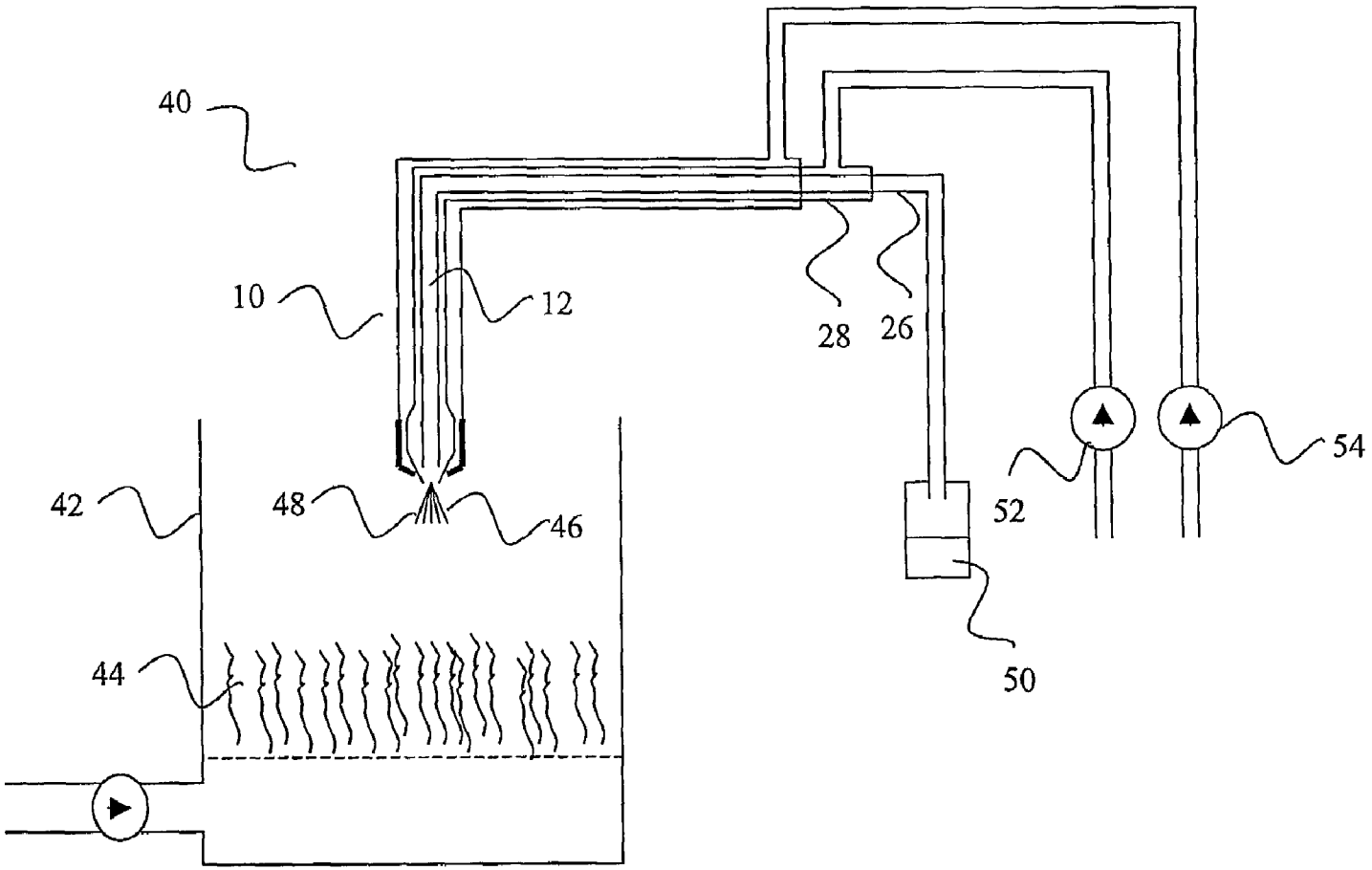
FIG. 1 schematically illustrates a preferred embodiment of an apparatus for controlled agglomeration according to the present invention.

FIG. 1 schematically illustrates a preferred embodiment of an apparatus 40 for controlled agglomeration according to the present invention. The illustrated apparatus 40 comprises a spray nozzle 10 according to the present invention.

The apparatus 40 further comprises a fluid bed 42 for fluidisation of a second composition 44 at ambient temperature. The spray nozzle 10 is mounted above the fluid bed 42 for spraying a first composition 46 comprising the carrier 48 in liquid form on the second composition 44 fluidised in the fluid bed 42.

A temperature and pressure controlled tank 50 of the apparatus 40 contains the first composition 46 and is connected to the central tube 26 with the central passage 12 for supply of the first composition 46 at a temperature above the melting point of the carrier 48.

Temperature controlled primary air is supplied to the spray nozzle 10 from a first temperature controlled pressurised air supply 52 that is connected to the second tube 28.

Temperature controlled secondary air is supplied to the spray nozzle 10 from a second temperature controlled pressurised air supply 54 that is connected to the third tube 30.

Figure 3:
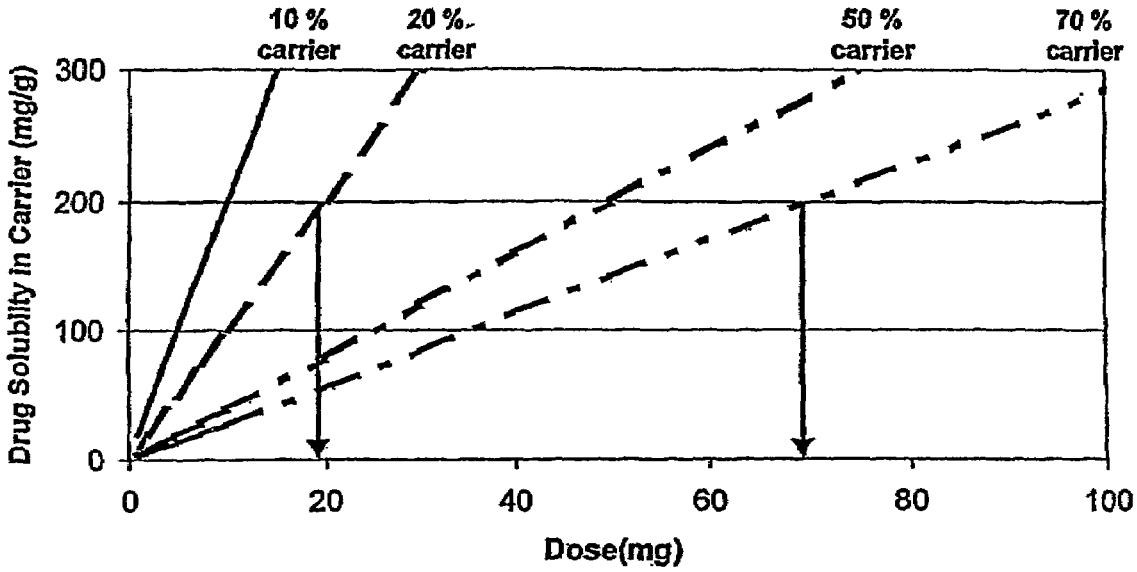
FIG. 3 shows the relationship between obtainable dose and drug solubility in a carrier at different concentrations of carrier assuming a formulation unit weight of 500 mg.

The possibility of controlling the agglomeration makes it possible to obtain a particulate material that has a very high load of carrier(s)—much higher than described when conventional methods like e.g. melt granulation is employed. As discussed above, a high load of carrier has shown to be of importance especially when particulate material is prepared containing a slightly water-soluble, sparingly water soluble or insoluble active substances. FIG. 3 is a theoretically calculated curve showing the relationship between obtainable dose and drug solubility in a carrier composition at different carrier concentrations in the particulate material assuming a total composition weight of 500 mg. It is seen that the dose can be increased by a factor of about 3.5 by increasing the concentration of carrier from 20% to 70%. By conventional melt granulation, i.e. a process by which heating of a melt binder and excipients is performed; normally a load of at the most about 15% w/w of the melt binder is obtained (calculated on the final composition). Another granulation method, which makes use of the same temperature of the binder and the material to be granulated, is a conventional granulation process, which is performed either by a wet or a dry granulation process.

Figure 4:
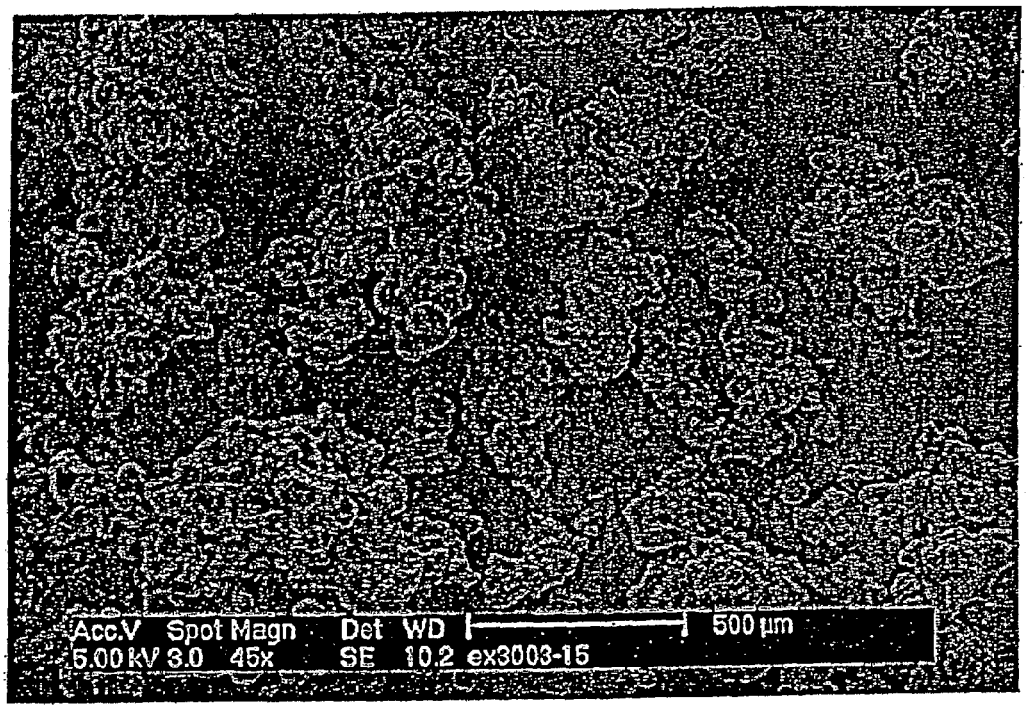
FIG. 4 is a SEM micrograph of PEG sprayed onto lactose 125 mesh; the PEG concentration is 48% w/w. Magnification×45.

A SEM micrograph in FIG. 4 shows a particulate material prepared by an apparatus according to the present invention. PEG 6000 is used as a carrier and lactose is used as the second composition. FIG. 4 shows that the primary particles of lactose are agglomerated by immersion in the droplets of PEG 6000 or by coalescence between larger agglomerates. The agglomerates are partly coated with PEG 6000. The probability of agglomerate growth by coalescence is reduced by rapidly solidifying PEG due to the product temperature being kept at a minimum of 10° C. below the melting point of PEG.

Figure 5:
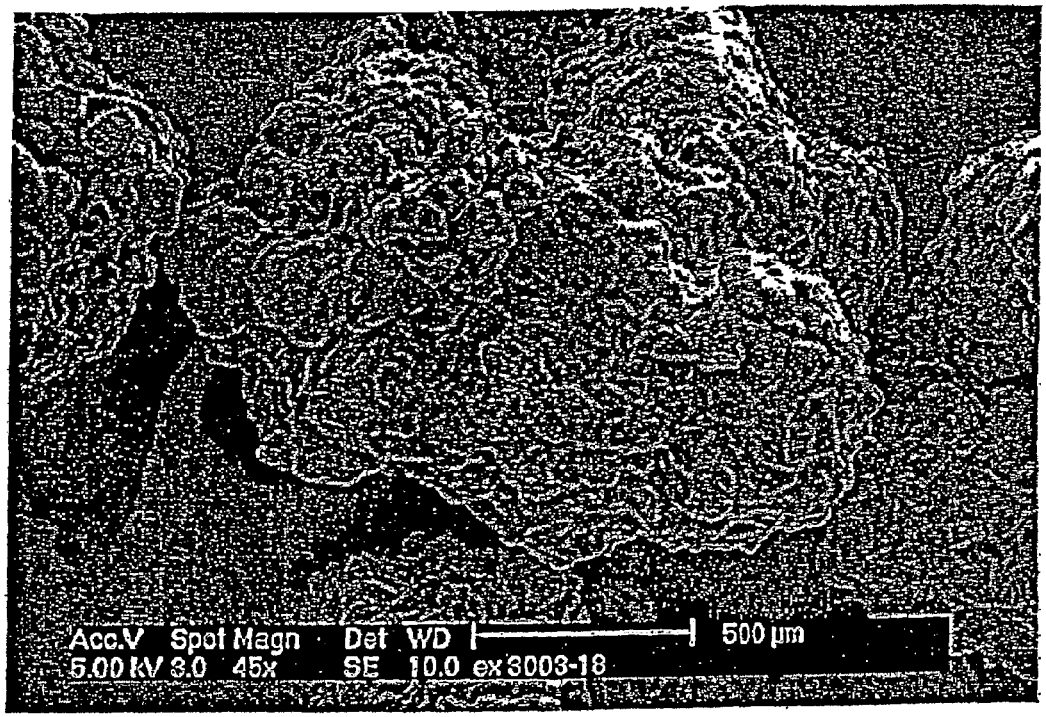
FIG. 5 is a SEM micrograph of PEG sprayed onto lactose 125 mesh; the PEG concentration is 25% w/w. Magnification×45.shows results from Example 4.
Figure 6:
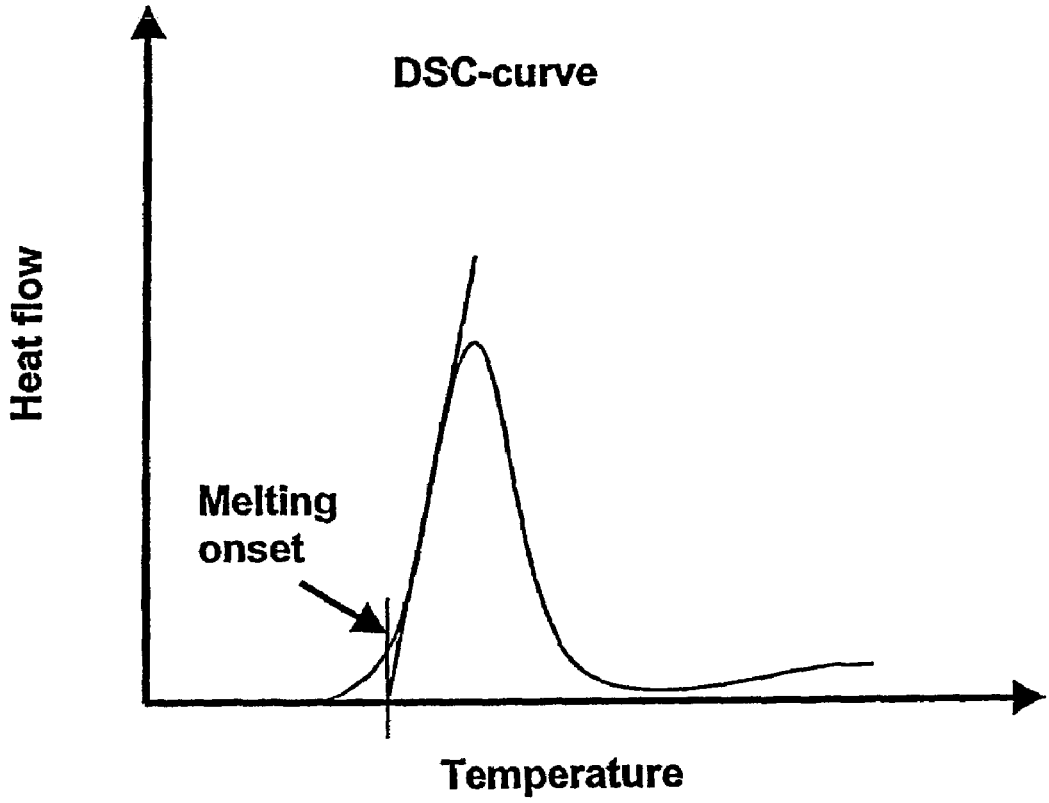
FIG. 6 illustrates determination of a melting point by a DSC curve.

In contrast thereto, uncontrolled agglomeration is shown in a SEM micrograph in FIG. 5. The particulate material is prepared according to Example 2 herein (uncontrolled agglomeration) using PEG 6000 as carrier and lactose as excipients. FIG. 5 shows that the particulate material has larger agglomerates with surplus of liquefied PEG at the surface of the agglomerates increasing the probability of agglomerate growth by coalescence at elevated product temperature.

The particulate material obtained by an apparatus of the invention has a geometric weight mean diameter $d_{gw}$ of ≧10 μm such as, e.g., ≧20 μm, from about 20 to about 2000, from about 30 to about 2000, from about 50 to about 2000, from about 60 to about 2000, from about 75 to about 2000 such as, e.g. from about 100 to about 1500 μm, from about 100 to about 1000 μm or from about 100 to about 700 μm. In specific embodiments the geometric weight mean diameter $d_{gw}$ is at the most about 400 μm or at the most 300 μm such as, e.g., from about 50 to about 400 μm such as, e.g., from about 50 to about 350 μm, from about 50 to about 300 μm, from about 50 to about 250 μm or from about 100 to about 300 μm.

Many characteristics of the particulate material obtained by an apparatus according to the invention have already been discussed. In summary, a particulate material has good tabletting properties including good flowability and compactability. It has no or minimal adherence to the tabletting equipment either in itself or after addition of the normal amount of lubricants. It is an excellent alternative for incorporation of active substances with very low water solubility and/or with a very low bioavailability, or active substances, which are subject to degradation in the presence of water (the process may be carried out without any water).

Thus, a particulate material of the invention is excellent for a further processing into e.g. tablets. In contrast to capsules, tablets are normally easier and cheaper to produce and tablets are often preferred by the patient. Furthermore, a tablet formulation is relatively easy to adjust to specific requirements, e.g. with respect to release of the active substance, size etc.

The particulate material obtained by an apparatus according to the invention may be used as such, or it may be further processed to the manufacture of a pharmaceutical and/or a cosmetic composition by addition of one or more suitable pharmaceutically and/or cosmetically acceptable excipients. Furthermore, the particulate material obtained may be provided with a coating to obtain coated particles, granules or pellets. Suitable coatings may be employed in order to obtain composition for immediate or modified release of the active substance and the coating employed is normally selected from the group consisting of film-coatings (for immediate or modified release) and enteric coatings or other kinds of modified release coatings, protective coatings or anti-adhesive coatings.

The particulate material obtained by an apparatus of the invention is especially suitable for further processing into tablets. The material possesses suitable properties for tabletting purposes, cf. below, but in some cases it may be suitable to add further therapeutically and/or prophylactically active substances and/or excipients to the particulate material before the manufacture of tablets. For examples, by using a mixture of i) an active substance contained in modified release coated granules or granules in the form of modified release matrices and ii) an active substance in freely accessible form, a suitable release pattern can be designed in order to obtain a relatively fast release of an active substance followed by a modified (i.e. often prolonged) release of the same or a different active substance.

As appears from the above, a particulate material obtained by an apparatus of the invention is suitable for use in the manufacture of tablets obtained by direct compression. Furthermore, the particulate material may in itself be employed as a binding agent for use in dry granulation processes.

A particulate material obtained by an apparatus according to the invention may be employed in any kind of pharmaceutical compositions in which the use of a solid particulate material is applicable. Thus, relevant pharmaceutical compositions are e.g. solid, semi-solid, fluid or liquid composition or compositions in the form of a spray. The particulate material may also be incorporated in a suitable drug delivery device such as, e.g. a transdermal plaster, a device for vaginal use or an implant.

Solid compositions include powders, and compositions in dosage unit form such as, e.g. tablets, capsules, sachets, plasters, powders for injection etc.

Semi-solid compositions include compositions like ointments, creams, lotions, suppositories, vagitories, gels, hydrogels, soaps, etc.

Fluid or liquid compositions include solutions, dispersions such as, e.g., emulsions, suspension, mixtures, syrups, etc.

Figure 7A:
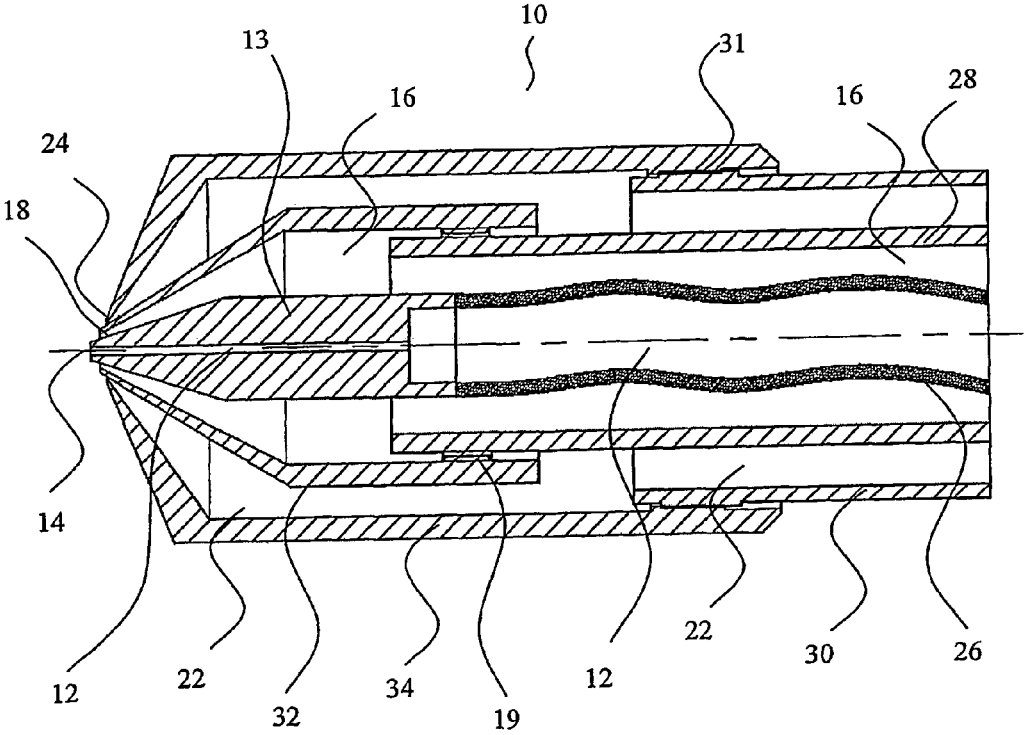
FIG. 7*a* illustrates a preferred embodiment of a spray nozzle according to the present invention.

A preferred embodiment of a spray nozzle 10 according to the present invention is shown in FIG. 7*a*. The spray nozzle 10 comprises a central tube 26 defining a central passage 12 for supply of liquid to a nozzle tip 13. The central tube 26 is a flexible hose comprising a Teflon® inner liner reinforced with a protective plastic cover. The hose 26 is attached to the nozzle tip 13. The hose 26 and the nozzle tip 13 form a unit that is removably attached to the spray nozzle 10 so that this unit may be removed and discarded and substituted by a new unit between batch processing whereby simple cleaning and sterilization of the spray nozzle is achieved. The nozzle tip 13 comprises a part of the central passage 12, the passage terminating in a nozzle orifice 14 for discharge of the liquid. The central tube 26 is surrounded by a second tube 28 whereby a first passage 16 generally surrounding and concentric with the central passage 12 for supply of primary air is defined between the central tube 26 and the second tube 28.

The second tube 28 is terminated in a nozzle cone 32 at the end of the second tube 28 whereby a part of the first passage 16 is defined between the nozzle tip 13 and the nozzle cone 32. The first discharge gap 18 is formed between the nozzle cone 32 and the nozzle tip 13 at the end of the nozzle cone 32 proximate to the orifice 14. At the end of the second tube 28, a thread 19 is provided for engagement with a corresponding thread provided inside the nozzle cone 32. The nozzle cone 32 is removably attached to the second tube 28 in threaded engagement. The size of the first discharge gap 18 may be adjusted by rotation of the nozzle cone 32.

The second tube 28 is surrounded by a third tube 30 whereby a second passage 22 surrounding and concentric with the first passage 16 for supply of secondary air is defined between the second tube 28 and the third tube 30. A jacket 34 is provided at the end of the third tube 30 whereby a part of the second passage 22 is defined between the nozzle cone 32 and the jacket 34. A second discharge gap 24 generally concentric with the first discharge gap 18 is defined between the jacket 34 and the nozzle cone 32 at a distance upstream in relation to the first discharge gap 18. At the end of the third tube 30, a thread 31 is provided for engagement with a corresponding thread in the nozzle jacket 34. The jacket 34 is attached to the third tube 30 in threaded engagement. The size of the second discharge gap 24 may be adjusted by rotation of the jacket.

Temperature controlled air supplied through the second passage 22 prevents deposition of material on the outer surface of the spray nozzle 10 adjacent the orifice 14.

The tubes 28, 30, the nozzle tip 13 and the nozzle cone 32 are made of different types stainless steel, e.g. AISI 316 and SAF 2205. It is important that parts in movable engagement with each other, e.g. the first tube 28 and the nozzle cone 32, be made of different types of stainless steel to prevent reaming.

The jacket 34 is tapered towards the second discharge gap so that during spraying the jacket 34 substantially does not present any horizontal surfaces whereby deposition of substance on the spray nozzle is further minimised.

Further, surfaces of the spray nozzle may be coated, e.g. with teflon, especially in the vicinity of the orifice 14 for further inhibition of deposition of material at the spray nozzle 10 that might clog the spray nozzle and prevent further operation without cleaning.

Figure 7B:
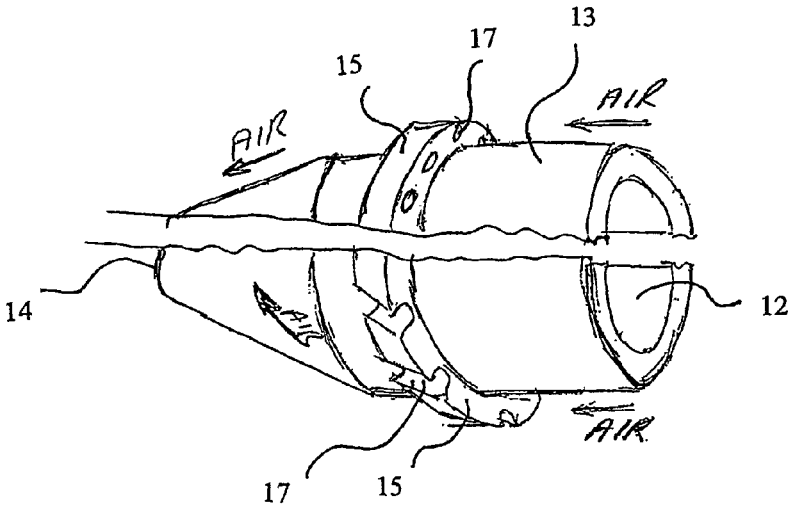
FIG. 7*b* illustrates a nozzle tip and a member according to the present invention.

Two embodiments of the nozzle tip 13 are illustrated in FIG. 7*b* with a member 15 having apertures or channels 17 for passage of the primary air. In the upper embodiment, the channels 17 lead the primary air straight through the member 15 without changing the direction of the primary airflow. In the lower embodiment, the longitudinal axes of the apertures or channels 17 form an angle with a longitudinal axis of the central tube whereby a swirling flow is induced in the primary airflow. The swirling motion of the flow creates a vortex and a region of relatively low pressure whereby the spray angle is increased.

In FIGS. 8-16, photographs of depositions on the spray nozzle 10 after operation in a controlled agglomeration apparatus at various operating temperatures of the primary air and the secondary air.

The following parameter values are valid for all of FIGS. 8-16:

Atomiser air flow: 1.9 $m^3/h$

Secondary air flow: 2.4 $m^3/h$

Temperature setting of carrier tank 50: 90° C.

Feeding tube temperature: 85° C.

First composition flow: 10-20 g/min

Second composition: 300 g lactose 200 Mesh.

Fluidising air flow: 20-40 $m^3/h$ at ambient temperature (20-23° C.)

Applied amount of carrier: 250 g

Figure 8:
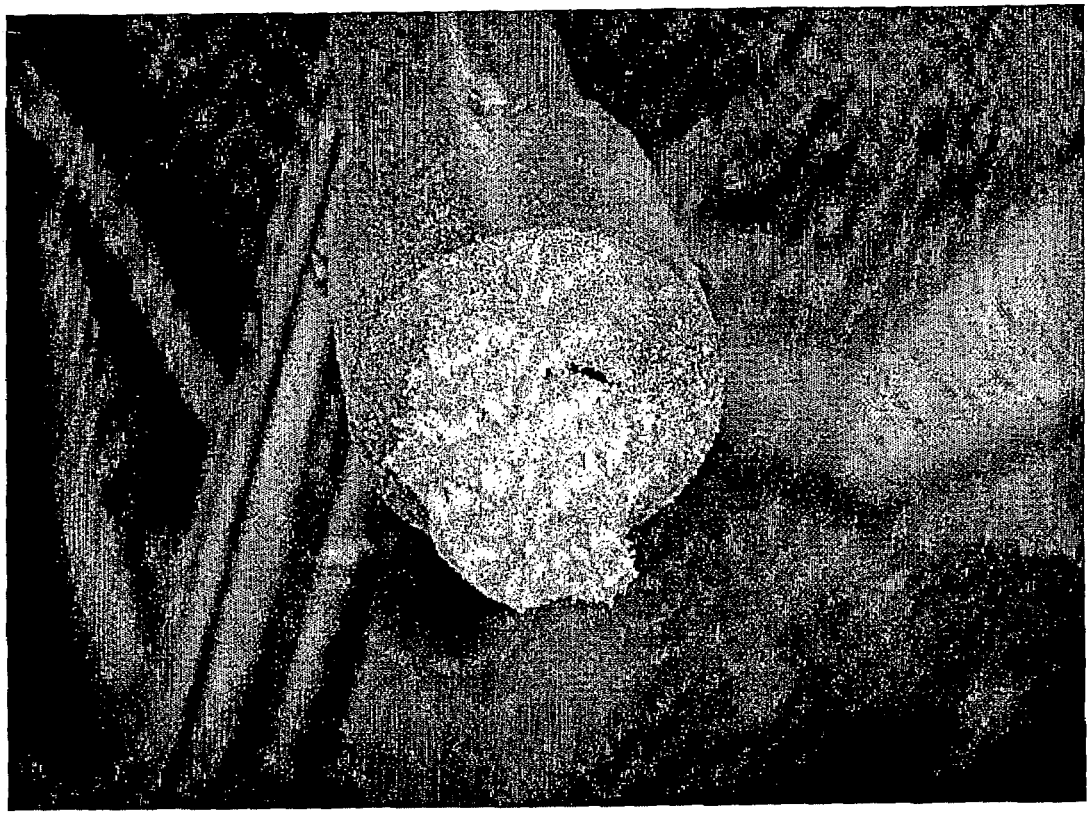
FIGS. 8-16 show photographs of depositions on the spray nozzle after operation in a controlled agglomeration apparatus at various operating temperatures.
Figure 9:
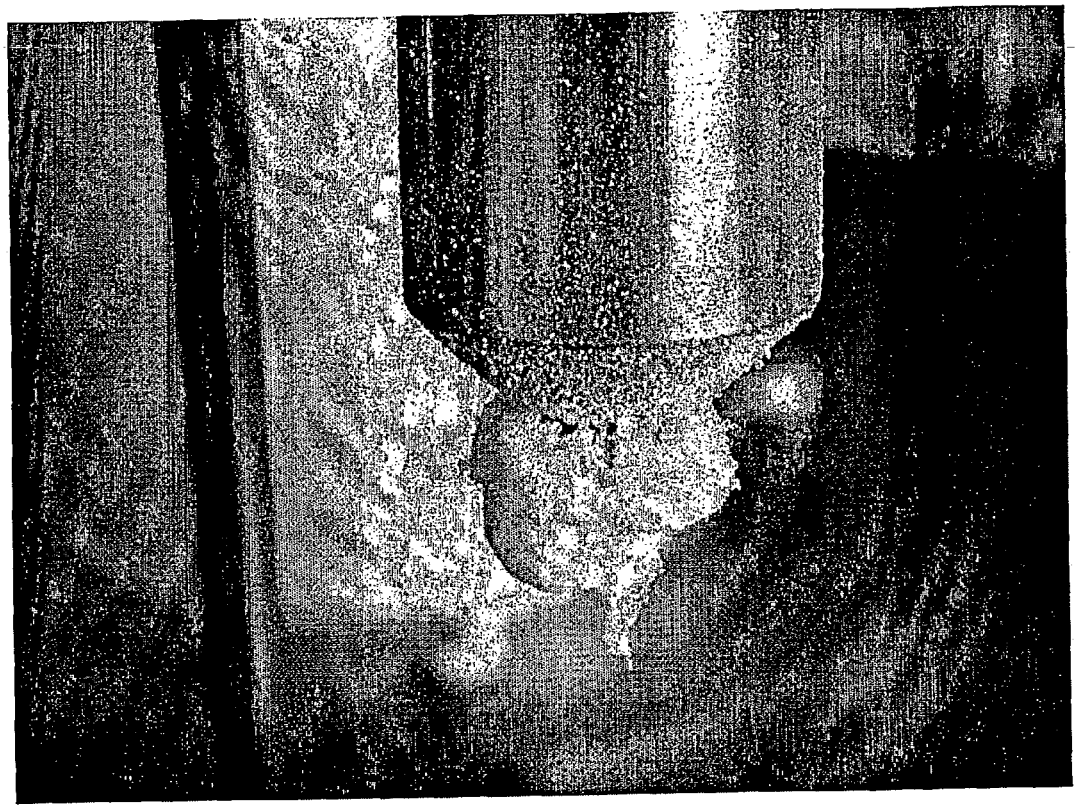

In FIGS. 8-12, PEG 3000 having a melting temperature in the range 48-54° C. was sprayed on the second composition. FIGS. 8 and 9 show the spray nozzle after operation with an atomiser air temperature setting at 100° C. and a secondary air temperature setting at 60° C. As seen in FIGS. 8 and 9, material was deposited on the spray nozzle, and atomisation was interrupted. At these conditions, but without the first and second composition, the temperature at the spray nozzle was measured to be 48° C., i. e. at the lower end of the melting range of PEG 3000. This is believed to cause solidification of the melted carrier at the tip of the nozzle.

Figure 10:
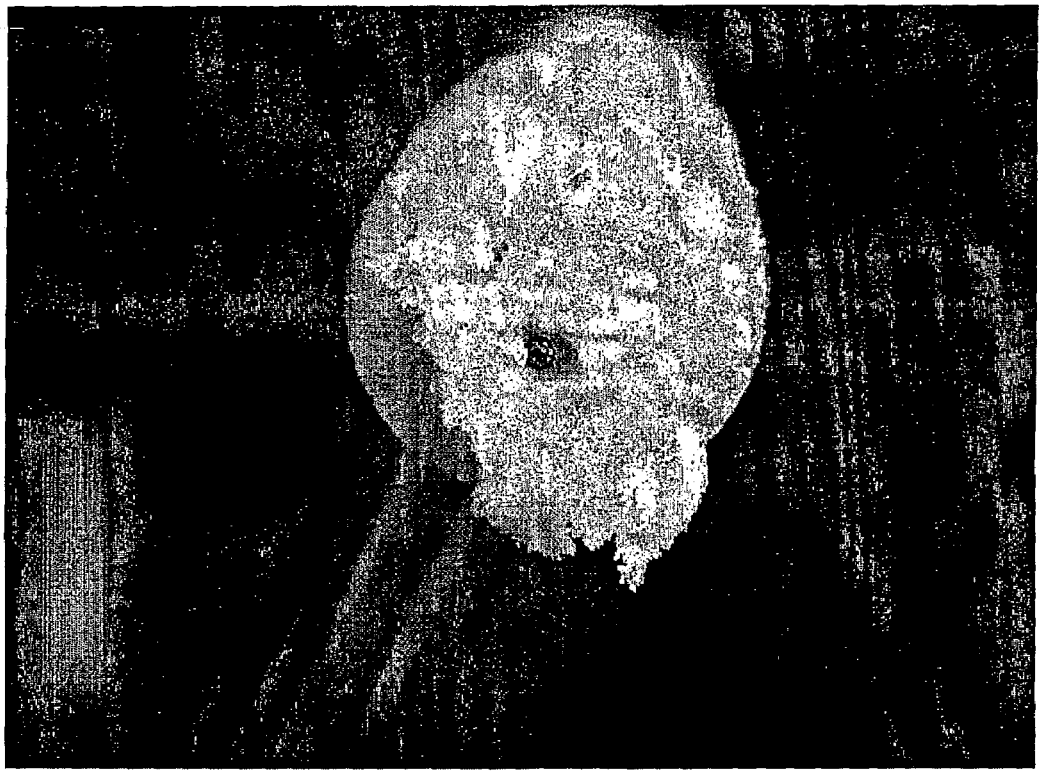

FIG. 10 shows the spray nozzle after operation with an atomiser air temperature setting at 140° C. and a secondary air temperature setting at 80° C. As seen in FIG. 10, material was deposited on the spray nozzle, however atomisation was not interrupted. At these conditions, but without the first and second composition, the temperature at the spray nozzle was measured to be 59° C., i. e. above the melting range of PEG 3000. It is believed that the nozzle surface temperature is too high causing adhesion of the melted carrier to the tip of the nozzle.

Figure 11:
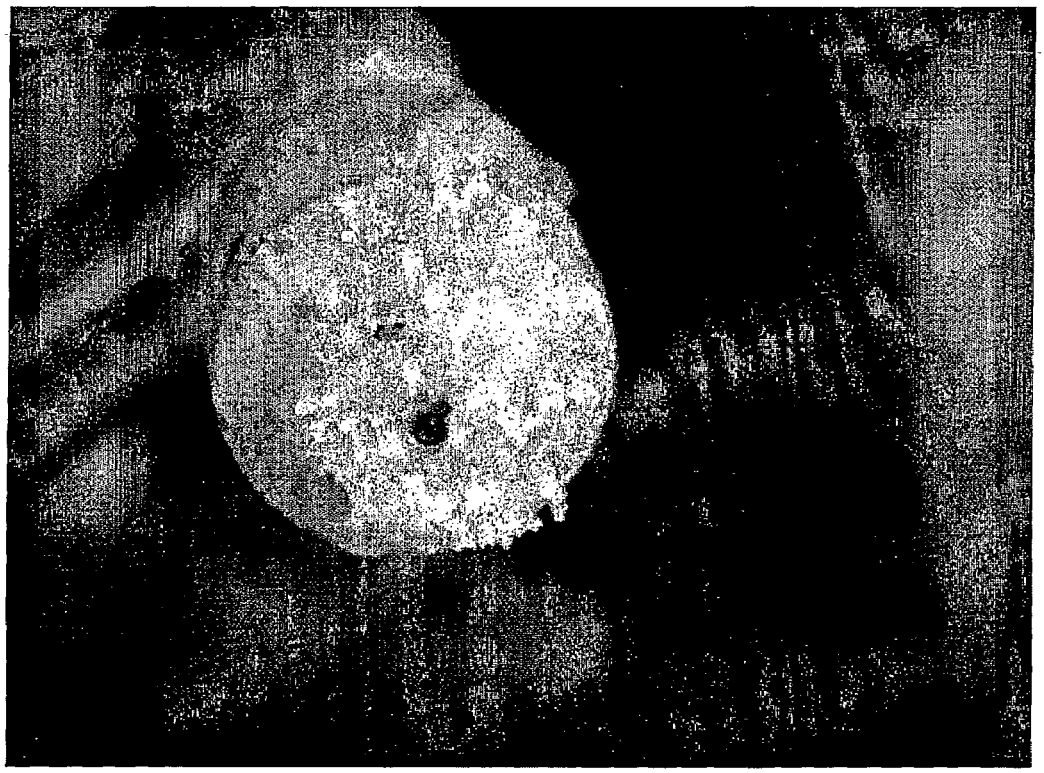
Figure 12:
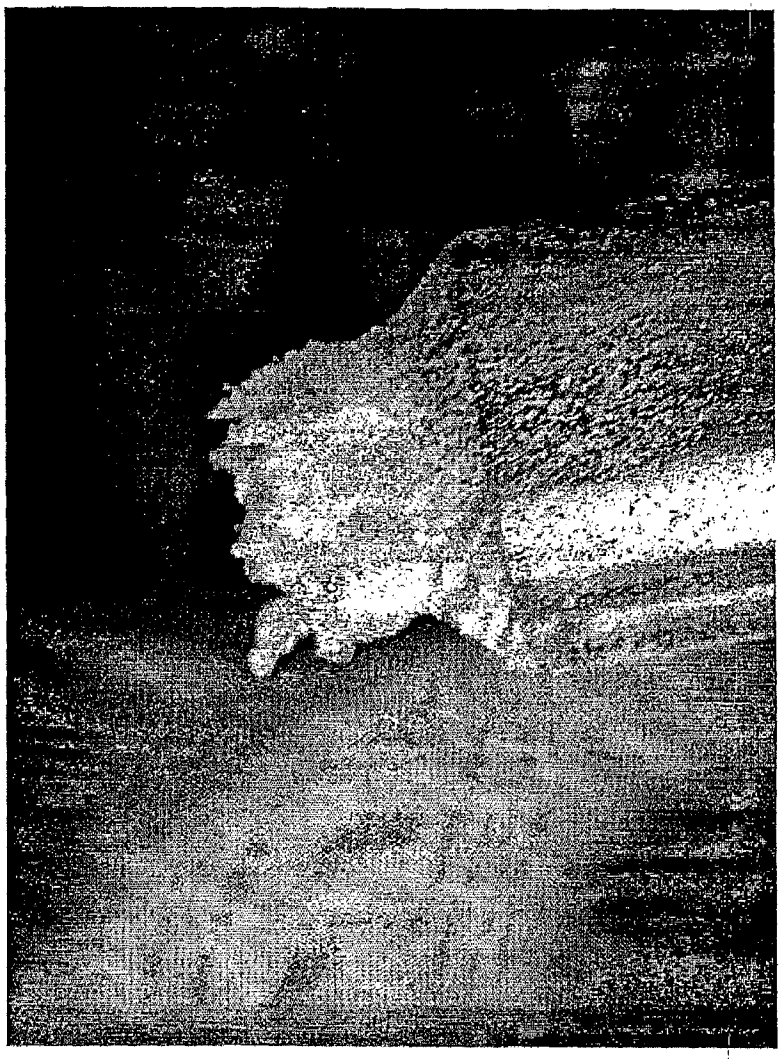

FIGS. 11 and 12 show the spray nozzle after operation with an atomiser air temperature setting at 140° C. and a secondary air temperature setting at 60° C. As seen in FIGS. 11 and 12, material was deposited on the spray nozzle, however atomisation was not interrupted. At these conditions, but without the first and second composition, the temperature at the spray nozzle was measured to be 58° C., i. e. above the melting range of PEG 3000. It is believed that the nozzle surface temperature is too high causing adhesion of the melted carrier to the tip of the nozzle.

In FIGS. 13-16, PEG 6000 having a melting temperature in the range 55-63° C. was sprayed on the second composition.

Figure 13:
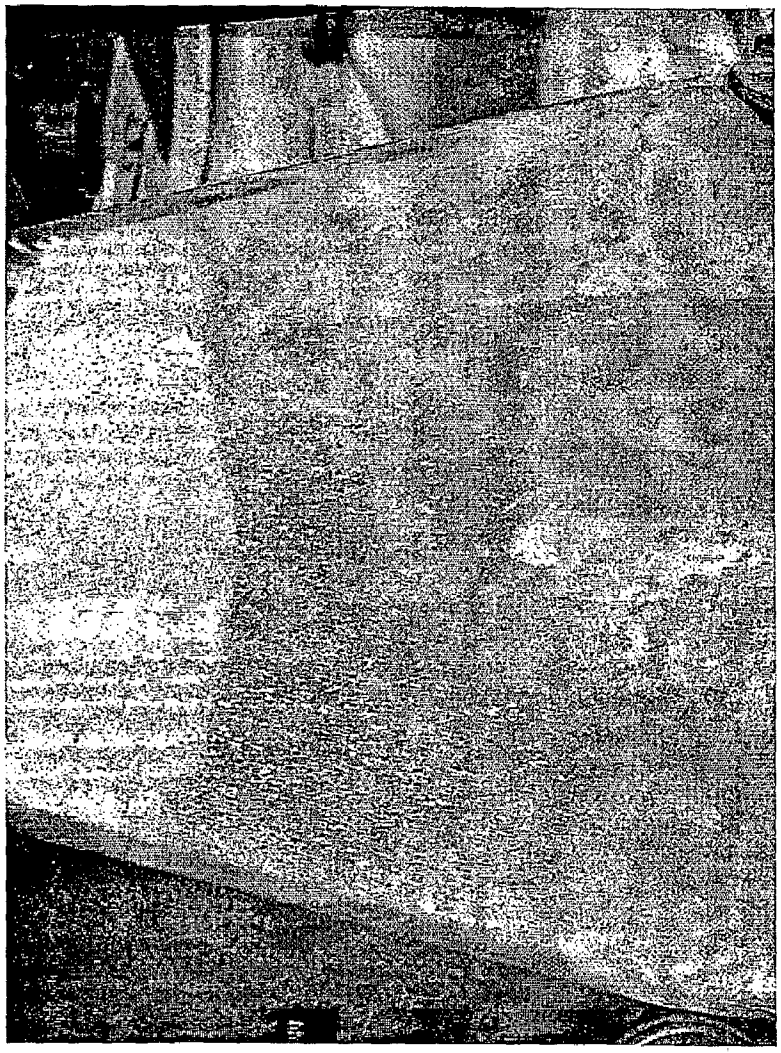

FIG. 13 shows the spray nozzle after operation with an atomiser air temperature setting at 140° C. and a secondary air temperature setting at 100° C. As seen in FIG. 13, material was deposited on the spray nozzle, however atomisation was not interrupted. At these conditions, but without the first and second composition, the temperature at the spray nozzle was measured to be 59° C. Adhesion is probably caused by liquid droplets acting as seeds for further adhesion of solid particles.

Figure 14:
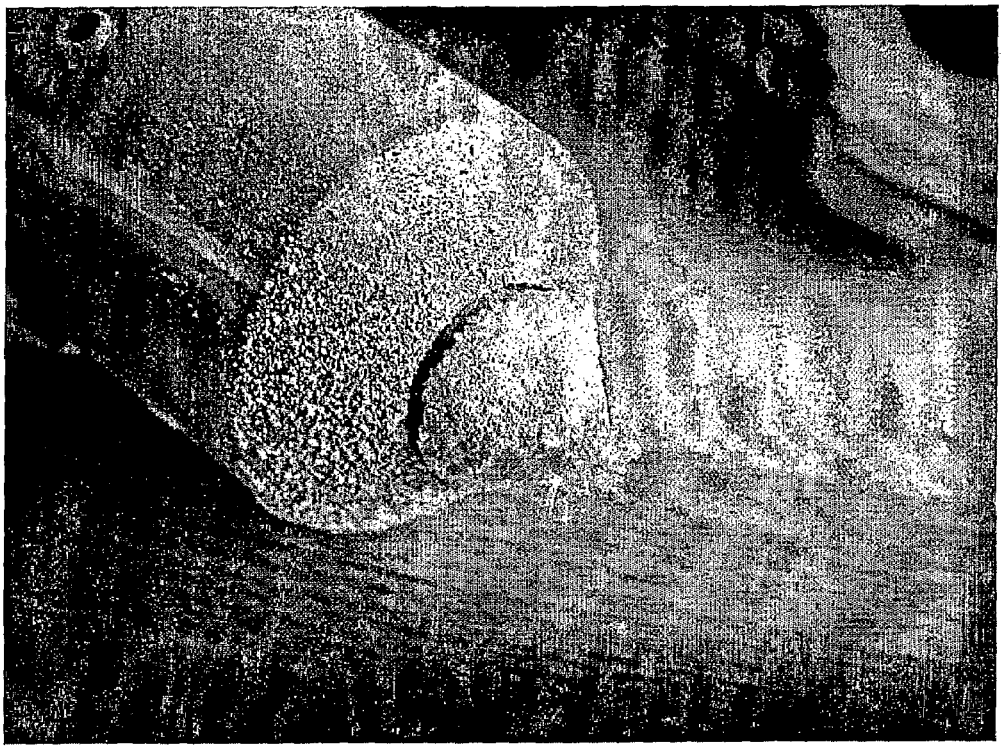

FIG. 14 shows the spray nozzle after operation with an atomiser air temperature setting at 140° C. and a secondary air temperature setting at 70° C. As seen in FIG. 10, material was deposited on the spray nozzle, and atomisation was very poor. At these conditions, but without the first and second composition, the temperature at the spray nozzle was measured to be 52° C., i. e. below the melting range of PEG 6000. It is believed that solidified liquid droplets and adhesion of solid particles of the second composition cause material deposition.

Figure 15:
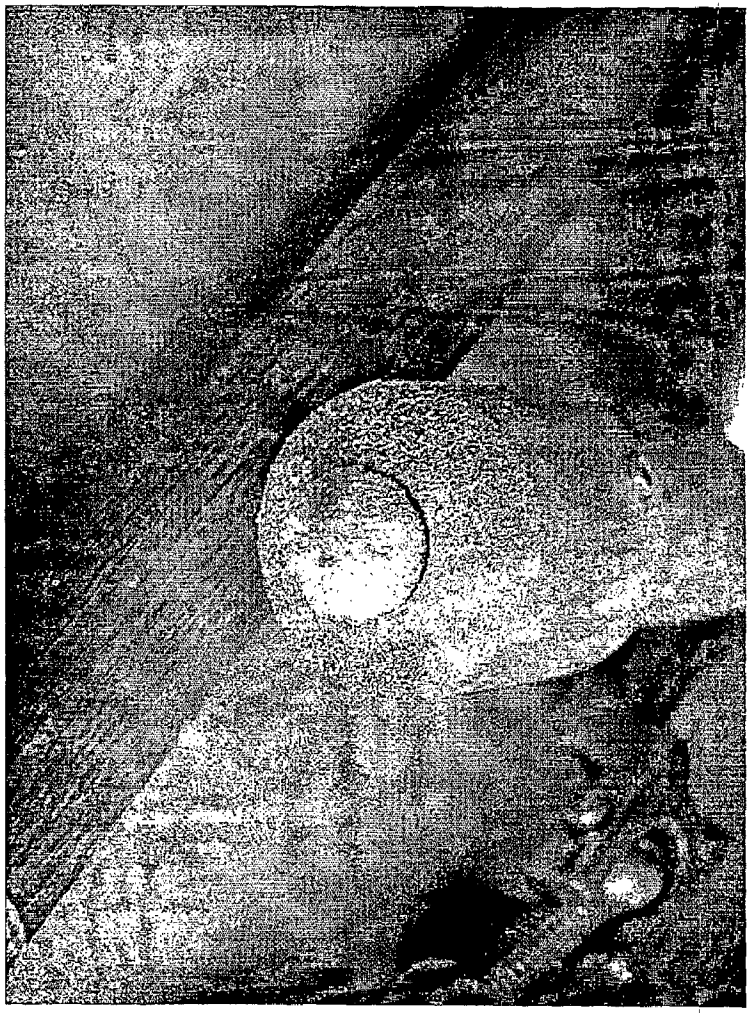

FIG. 15 shows the spray nozzle after operation with an atomiser air temperature setting at 140° C. and a secondary air temperature setting at 40° C. As seen in FIG. 15, a lot of material was deposited on the spray nozzle, and atomisation could not be achieved.

Figure 16:
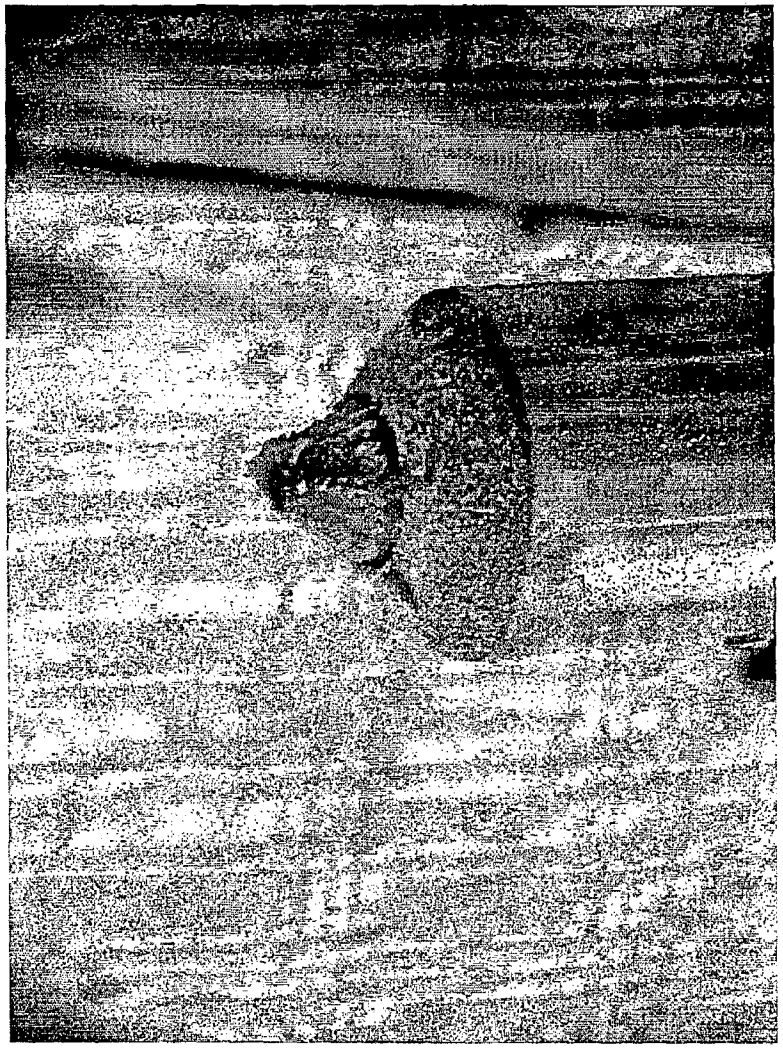

FIG. 16 shows the spray nozzle after operation with an atomiser air temperature setting at 140° C. and a secondary air temperature setting at 80° C. As seen in FIG. 16, very little material was deposited on the spray nozzle, and reliable atomisation was achieved. At these conditions, but without the first and second composition, the temperature at the spray nozzle was measured to be 54° C., i. e. close to the lower limit of the melting range of PEG 6000.

Thus, proper atomisation of the first composition requires that the atomising temperature at the nozzle orifice exceeds or at least correspond to the melting temperature of the carrier. Further, the atomisation airflow must be sufficient for atomisation of the first composition.

The temperature of the secondary air must be sufficiently low to cool the surface of the nozzle tip to the lower end of the melting temperature range of the carrier. If the temperature is higher, adhesion of liquid droplets might result in deposits of solid second composition material. If the temperature is lower, liquid droplets might solidify and act as seeding for build up of deposits.

The secondary airflow should be sufficient to create a heating zone around the nozzle and reduce the deposits of solid particles around the orifice in the counter current airflow of the fluid bed.

Some examples of preparation of a particulate material with an apparatus according to the present invention are given below.

Materials

All materials employed were of pharmaceutical grade.

Calcium hydrogen phosphate (Di-cafos A): Budenheim
Croscarmellose Sodium Ac-Di-Sol: FMC
Magnesium stearate: Magnesia GmbH
Polyethylene glycol: Hoechst
Lactose: DMV Other materials employed appear from the following examples.

EXAMPLE 1

Preparation of a Particulate Material with an Apparatus According to the Invention The example illustrates the preparation of a particulate material comprising a relatively large amount of a carrier. The particulate material obtained exhibits good flowability, good compactability and possesses excellent tabletting properties. Thus, the particulate material allow the preparation of e.g. tablets and in spite of the relatively large load of carrier the tablets display minimal, if any, adherence (sticking) to tablet punches and/or dies during compression. Furthermore, the tablets obtained have acceptable properties with respect to disintegration, weight variation and hardness.

Starting Materials

Lactose monohydrate (DMV) 125 mesh
Calcium hydrogen phosphate anhydrous (Di-Ca-Fos P)
Polyethylene glycol 6000 (PEG 6000) having a melting point of about 60° C.

Equipment

Fluid bed Strea-1 (from Aeromatic-Fielder) mounted with a spray nozzle according to the present invention with an orifice of 0.8 mm.

Granular Compositions

Composition 1.1
Lactose 500 g
PEG 6000 420 g (sprayed on lactose)

The composition has a carrier concentration of 45.6% w/w.

Composition 1.2
Calcium hydrogen phosphate anhydrous 500 g

PEG 6000 210 g (sprayed on calcium hydrogen phosphate)

The composition has a carrier concentration of 29.6% w/w.

Process Conditions—Description

Lactose (or for composition 1.2 calcium hydrogen phosphate anhydrous) was fluidised at appropriate inlet airflow. The inlet air was not heated. PEG 6000 was melted using an electrically heated pressure tank. The temperature was kept at a temperature at about 85° C., i.e. above the melting point of PEG 6000. The melt was pumped from the tank to the nozzle through a heated tube. In the tube, the temperature was kept at 80° C. The pressure in the tank determined the flow rate of the melt. The nozzle was heated to keep the droplets in a liquefied stage by means of heating the atomizer air delivered through the top-spray nozzle.

Settings

Inlet airflow: 30-50 $m^3$ per hour

Inlet air temperature: Ambient temperature (20-25° C.)

Tank temperature: 85° C.

Tank pressure: 1.5 Bar corresponding to a flow rate of 14-15 g/min

Tube temperature: 80° C.

Primary air temperature: 100° C.

Process time: 28 min

Product temperature at equilibrium: 40° C. (after 15 minutes)

Product Characteristics

The products (composition 1.1 and 1.2) appear as free flowing granular products with a mean granule size of approx. 300-500 μm.

EXAMPLE 2

Controlled Agglomeration—Proof of Concept

Method

Controlled agglomeration is obtained by keeping the product temperature at minimum 10° C. below melting point of the carrier reducing the probability of agglomeration due to coalescence. Controlled agglomeration is characterised by gradual increase in mean granule size (geometric weight mean diameter $d_{gw}$) as function of applied amount of carrier. In contrast, uncontrolled agglomeration shows rapidly increasing granule size. As a proof of concept the granule growth pattern are compared corresponding to the following conditions:

Inlet fluidising air temperature of ambient temperature: 20-25° C.

Inlet fluidising air temperature of 85° C. leading to a temperature of the product of about 50-60° C., Starting Materials Lactose monohydrate 125 mesh Polyethylene glycol 6000

Equipment

Fluid bed Strea-1 mounted with a spray nozzle according to the present invention.

Granular Compositions

Lactose 400 g

PEG 6000 increased stepwise in separate experiments (from 0% to about 60% w/w in the final composition)

Process Conditions

The conditions were the same as described in Example 1.

Settings (Controlled Agglomeration)

Inlet airflow: 30-50 $m^3$ per hour

Inlet air temperature: Ambient temperature (20-25° C.)

Tank temperature: 90° C.

Tank pressure: 1.5 Bar corresponding to a flow rate of 14-15 g/min

Tube temperature: 85° C.

Atomizer air temperature: 100° C.

Product temperature at equilibrium: 40° C.

Settings (Uncontrolled Agglomeration)

Inlet airflow: 30-50 m3 per hour

Inlet air temperature: 85° C.

Tank temperature: 90° C.

Tank pressure: 1.5 Bar corresponding to a flow rate of 14-15 g/min

Tube temperature: 85° C.

Atomizer air temperature: 100° C.

Product temperature at equilibrium: 55-65° C. Product characteristics

Increasing amounts of PEG were sprayed onto the fluidised lactose particles and the particle size distribution of the products was analysed by method of laser diffraction, dispersing the agglomerates in air. The correlation between mean granule size (geometric weight mean diameter $d_{gw}$) and applied amount of carrier demonstrates the difference between controlled and uncontrolled agglomeration as shown in FIG. 2 and Table 1. Table 1 includes the geometric standard deviation $s_g$ related to the wideness of the size distribution.

TABLE 1

Particle sizes characteristics of granulate products produced by agglomeration by melt spraying in fluid bed at heated and unheated inlet air conditions at different applied amount of PEG 6000 concentrations.

| Product temperature 40-45° C. Inlet air temperature: Ambient | | | Product temperature 50-60° C. Inlet air temperature: 85° C. | | |
|---|---|---|---|---|---|
| PEG, w/w % | $D_{gw}$, μm | $S_g$ | PEG w/w % | $D_{gw}$, μm | $S_g$ |
| 0 | 55 | 2.37 | 0 | 55 | 2.37 |
| 17 | 151 | 2.09 | 13 | 343 | 1.98 |
| 26 | 261 | 2.09 | 15 | 513 | 1.48 |
| 38 | 328 | 2.06 | 25 | 980 | 1.43 |
| 48 | 332 | 1.95 | | | |
| 60 | 450 | 1.8 | | | |

$D_{gw}$: Geometric weight mean diameter.
$S_g$: Geometric standard deviation.

Figure 17:
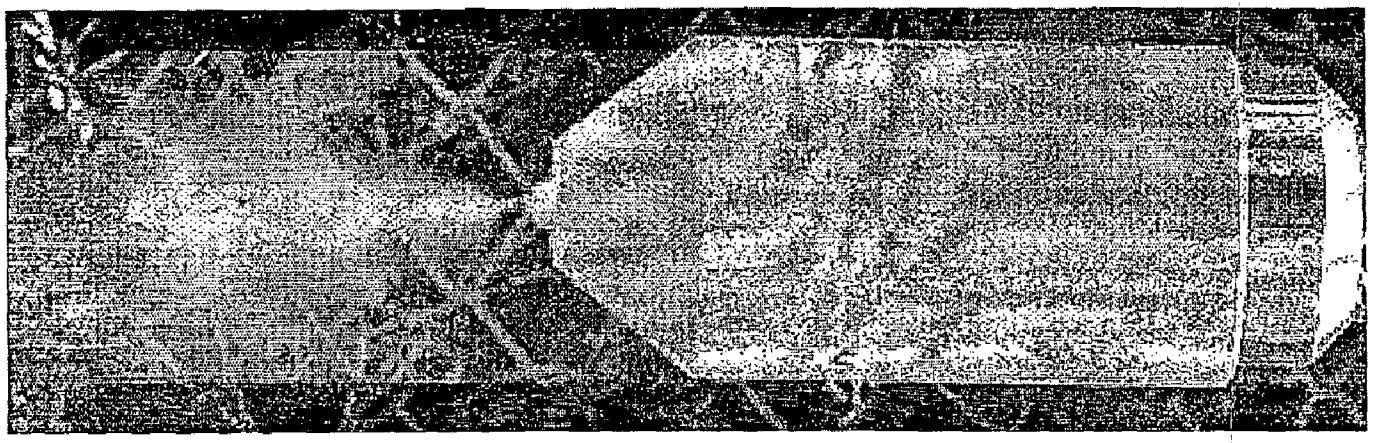
FIG. 17 shows a photograph of spray nozzle operating with a low spray angle.

FIG. 17 is a photograph of a preferred embodiment of a spray nozzle according to the present invention, operating with a low spray angle of approximately 5°.

The invention claimed is:

1. A spray nozzle comprising:

a central tube with a central passage for supply of a liquid, the passage terminating in an orifice for discharge of the liquid, a second tube surrounding the central tube whereby a first passage is defined between the central tube and the second tube for supply of primary air, a nozzle cone positioned at the end of the second tube and defining the outer periphery of a first discharge gap of the first passage, causing air supplied through the first passage to be mixed with the liquid to provide a liquid/air spray, a third tube surrounding the second tube whereby a second passage is defined between the second and the third tube for supply of secondary air, and a jacket positioned at the end of the third tube and defining the outer periphery of a second discharge gap of the second passage, characterized in that the nozzle cone is adjustably positioned at the end of the second tube for adjustment of the size of the first discharge gap.

2. A spray nozzle according to claim 1, wherein the nozzle cone is removably attached to the second tube.

3. A spray nozzle according to claim 1, wherein the jacket is adjustably positioned at the end of the third tube for adjustment of the size of the second discharge gap.

4. A spray nozzle according to claim 1, wherein the jacket is removably attached to the third tube.

5. A spray nozzle according to claim 1, wherein the first discharge gap is positioned at a distance upstream in relation to the orifice.

6. A spray nozzle according to claim 1, wherein the second discharge gap is positioned at a distance upstream in relation to the first discharge gap.

7. A spray nozzle according to claim 1, wherein the central tube is removable.

8. A spray nozzle according to claim 7, wherein the central tube and the nozzle tip constitutes a removable unit of the spray nozzle.

9. A spray nozzle according to claim 1, further comprising a removable nozzle tip positioned at the end of the central tube and comprising the orifice.

10. A spray nozzle according to claim 1, wherein the central tube is a flexible hose, comprising a Teflon® liner.

11. A spray nozzle according to claim 1, wherein the nozzle cone is made of stainless steel.

12. A spray nozzle according to claim 11, wherein the second tube is made of a different type of stainless steel whereby reaming is suppressed.

13. An apparatus for controlled agglomeration, comprising a spray nozzle according to claim 1, and further comprising:

a fluid bed for fluidization of a second composition having a temperature of at the most a temperature corresponding to a melting point of a carrier, such as a temperature of at least about 2° C., at least about 5° C. or at least about 10° C. lower than the melting point of the carrier, the spray nozzle being mounted in the fluid bed for spraying a first composition comprising the carrier in liquid form on the second composition fluidized in the fluid bed, a temperature and pressure controlled tank containing the first composition, and connected to the central passage for supply of the first composition at a temperature above the melting point of the carrier, a first temperature controlled pressurized air supply that is connected to the first passage for supplying temperature controlled primary air to the spray nozzle, and a second temperature controlled pressurized air supply that is connected to the second passage for supplying temperature controlled secondary air to the spray nozzle.

14. An apparatus according to claim 13, wherein the carrier has a melting point of about 5° C. or more such as, about 10° C. or more, about 20° C. or more or about 25° C. or more.

15. An apparatus according to claim 13, wherein the temperature of the supplied primary air is above the melting point of the carrier.

16. An apparatus according to claim 13, wherein the temperature of the supplied secondary air is at the lower end of the melting temperature range of the carrier.

17. An apparatus according to claim 13, wherein the fluid bed is a roto fluid bed.

18. An apparatus according to claim 13, wherein the fluid bed is a Wurster fluid bed.

19. An apparatus according to claim 13, wherein the fluid bed is a Kugel coater.

20. An apparatus according to claim 13, wherein the spray nozzle is mounted at the top of the fluid bed.

21. An apparatus according to claim 13, wherein the spray nozzle is mounted at the bottom of the fluid bed.

22. An apparatus for controlled agglomeration, comprising a spray nozzle according to claim 1, and further comprising:

an intensive mixer for mixing of a second composition having a temperature of at the most a temperature corresponding to a melting point of a carrier, such as a temperature of at least about 2° C., at least about 5° C. or at least about 10° C. lower than the melting point of the carrier, the spray nozzle being mounted in the mixer for spraying a first composition comprising the carrier in liquid form on the second composition during mixing in the intensive mixer, a temperature and pressure controlled tank containing the first composition, and connected to the central passage for supply of the first composition at a temperature above the melting point of the carrier, a first temperature controlled pressurized air supply that is connected to the first passage for supplying temperature controlled primary air to the spray nozzle, and a second temperature controlled pressurized air supply that is connected to the second passage for supplying temperature controlled secondary air to the spray nozzle.

23. An apparatus according to claim 22, wherein the intensive mixer is a high shear mixer.

24. An apparatus according to claim 22, wherein the intensive mixer is a low shear mixer.

25. An apparatus according to claim 22, wherein the intensive mixer is a horizontal mixer.

26. An apparatus according to claim 22, wherein the intensive mixer is a vertical mixer.

27. A spray dryer with a spray nozzle according to claim 1.

28. A spray dryer according to claim 27, wherein the spray nozzle is mounted at the top of the spray dryer.

29. A spray dryer according to claim 27, wherein the spray nozzle is mounted at the bottom of the spray dryer.

* * * * *